US005573608A

United States Patent [19]

Miyake et al.

[11] Patent Number: 5,573,608

[45] Date of Patent: Nov. 12, 1996

[54] SUPERPLASTIC ALUMINUM ALLOY AND PROCESS FOR PRODUCING SAME

[75] Inventors: Yoshiharu Miyake, Susono; Tetsuya Suganuma, Nagoya, both of Japan

[73] Assignee: Toyota Jidosha Kabushiki Kaisha, Japan

[21] Appl. No.: 450,554

[22] Filed: May 25, 1995

Related U.S. Application Data

[62] Division of Ser. No. 186,160, Jan. 25, 1994.

[30] Foreign Application Priority Data

| | | | |
|---|---|---|---|
| Jan. 27, 1993 | [JP] | Japan | 5-11679 |
| Jun. 29, 1993 | [JP] | Japan | 5-159348 |
| Jul. 14, 1993 | [JP] | Japan | 5-174415 |
| Aug. 23, 1993 | [JP] | Japan | 5-207823 |
| Sep. 7, 1993 | [JP] | Japan | 5-222377 |
| Sep. 30, 1993 | [JP] | Japan | 5-245075 |
| Nov. 30, 1993 | [JP] | Japan | 5-300365 |

[51] Int. Cl.[6] ..... C22F 1/04

[52] U.S. Cl. ..... 148/552; 148/564; 148/643; 148/694

[58] Field of Search ..... 148/549, 552, 148/564, 691–694

[56] References Cited

U.S. PATENT DOCUMENTS

| | | | |
|---|---|---|---|
| 4,486,242 | 12/1984 | Ward et al. | 148/693 |
| 4,618,382 | 10/1986 | Miyagi et al. | 148/693 |
| 4,689,090 | 8/1987 | Sawtell et al. | 148/552 |
| 5,122,196 | 6/1992 | Fernandez | 148/692 |

FOREIGN PATENT DOCUMENTS

| | | | |
|---|---|---|---|
| 50-155410 | 12/1975 | Japan . | |
| 60-5865 | 1/1985 | Japan . | |
| 60-238460 | 11/1985 | Japan . | |
| 62-96643 | 5/1987 | Japan . | |
| 62-170462 | 7/1987 | Japan . | |
| 62-238345 | 10/1987 | Japan . | |
| 4-504141 | 7/1992 | Japan . | |
| 6-81088 | 3/1994 | Japan | 148/552 |
| 2135694 | 9/1984 | United Kingdom . | |

OTHER PUBLICATIONS

"Microstructural Evolution by Continuous Recrystallisation in a Superplastic Al–Mg Alloy", S. J. Hales and T. R. McNelley, pp. 1229–1239, ACTA. Metall., vol. 36, No. 5, 1988.

"Grain Refinement and Superplasticity in a Lithium Containing Al–Mg Alloy by Thermomechanical Processing", S. J. Hales et al., pp. C3–285–C3–291, Journal De Physique, vol. 48, No. 9, Sep. 1987.

"Basis and Industrial Technology for Aluminum Materials", Table 1, p. 387, Japan Light Metal Association (1985).

(List continued on next page.)

*Primary Examiner*—George Wyszomierski

*Attorney, Agent, or Firm*—Finnegan, Henderson, Farabow, Garrett & Dunner, L.L.P.

[57] ABSTRACT

The present invention relates to a process for producing a superplastic aluminum alloy capable of being used for plastic working such as extrusion, forging and rolling. An object of the present invention is to provide an ingot-made high speed superplastic aluminum alloy in which superplasticity is developed at a strain rate higher than that of conventional static recrystallization type superplastic aluminum alloys, and a process for producing the same. The superplastic aluminum alloy of the invention has structure which is obtained by adding to a basic alloy containing from at least 4.0 to 15% by weight of Mg and from 0.1 to 1.0% by weight of one or more elements selected from the group consisting of Mm, Zr, V, W, Ti, Ni, Nb, Ca, Co, Mo and Ta, and further selective elements of Sc, Cu, Li, Sn, In and Cd, which contains from 0.1 to 4.0% by volume fraction of spheroidal precipitates of intermetallic compounds having a particle size from 10 to 200 nm, and which has a mean grain size from 0.1 to 10 μm.

9 Claims, 17 Drawing Sheets

OTHER PUBLICATIONS

"Superplasticity in Commercial Aluminum Alloys", K. Higashi, pp. 751–764, Journal of Japan Institute of Light Metals, vol. 39, No. 11 (1989).

"Superplasticity in a Thermomechanically Processed High–Mg, Al–Mg Alloy", T. R. McNelley, E. –W. Lee, and M. E. Mills, pp. 1035–1041, Metallurgical Transactions, vol. 17A, Jun. 1986.

"The Influence of Thermomechanical Processing Variables on Superplasticity in a High–Mg, Al–Mg Alloy", E. –W. Lee, T. R. McNelley, and A. F. Stengel, pp. 1043–1050, Metallurgical Transactions, vol. 17 A, Jun. 1986.

SUPERPLASTIC ALUMINUM ALLOY AND PROCESS FOR PRODUCING SAME

This is a division of application Ser. No. 08/186,160, filed Jan. 25, 1994.

BACKGROUND OF THE INVENTION

1. Field of Utilization in Industry

The present invention relates to a superplastic material, and particularly to an ingot-made high-speed superplastic aluminum alloy capable of being subjected to plastic working such as extruding, forging and rolling, and a process for producing the same.

2. Prior Art

Aluminum alloys are known to have superplasticity, and they include Al—Cu alloys, Al—Mg—Zn—Cu alloys, Al—Li alloys, Al—Mg—Si alloys, Al—Ca alloys, Al—Ni alloys, and the like (e.g., refer to "Basis and Industrial Technology for Aluminum Materials," p387, Table 1, Japan Light Metal Association (1985)).

Ordinary superplastic materials are superplastically deformed as a common practice by statically recrystallizing them prior to deformation to achieve grain refining, and applying a load at a high temperature at a low strain rate to effect boundary sliding. There is also known a dynamic recrystallization type aluminum alloy, which is dynamically recrystallized to form fine and uniform grain structure in the initial stage of high temperature deformation, and which is subsequently superplastically deformed (e.g., refer to K. Higashi, "Superplasticity in commercial aluminum alloys, "Journal of Japan institute of Light Metals, 39, No. 11, 751–764 (1989)).

Moreover, KOKAI (Japanese Unexamined Patent Publication) No. 50-155410 discloses a process, for producing a product, comprising non-superplastically deforming a material and superplastically deforming the deformed material while recrystallized grains having fine structure are being successively formed. Moreover, KOKAI (Japanese Unexamined Patent Publication) No. 60-5865 discloses a process, for superplastically deforming a material, comprising deforming the material at a first strain rate to induce dynamic recrystallization, and then deforming at a second strain rate. Furthermore, KOKAI (Japanese Unexamined Patent Publication) No. 60-238460 discloses a process for producing a fine grain superplastic material having a superplastic elongation as a process for producing a superplastic Al—Mg alloy, wherein warm working, heating and cooling, and cold working are carried out in combination. Still furthermore, KOKAI (Japanese Unexamined Patent Publication) No. 4-504141 discloses a process for producing an intermediately elongated product which can be superplastically deformed only after non-superplastically deforming for the purpose of dynamic recrystallization.

Since static-recrystallization-type superplastic aluminum alloys are prepared by forcibly working ingot-made materials (the working ratio being generally at least 70%) and recrystallizing the worked materials, materials in only a sheet form or wire form can be obtained. Accordingly, there is a limitation on the range of application of the materials to parts (products). Moreover, the strain rate for exhibiting superplasticity is slow, and the temperature therefor is relatively high. Furthermore, though dynamic-recrystallization-type aluminum alloys can be deformed at a high strain rate, their application is currently limited to materials prepared by high cost powder metallurgy or mechanical alloying.

Accordingly, there is a demand for superplastic materials which can be worked both at low temperature and at high strain rate.

DISCLOSURE OF THE INVENTION

An object of the present invention is to provide an ingot-made superplastic aluminum alloy capable of decreasing its hot deformation resistance and inhibiting grain growth during superplastic deformation of an Al—Mg superplastic alloy, and while being subjected to plastic working such as extruding, forging and rolling.

Another object of the present invention is to provide a superplastic aluminum alloy in which the strain rate for exhibiting superplasticity is higher than that of the conventional static-recrystallization-type superplastic aluminum alloy.

A still another object of the present invention is to provide a process for producing such a superplastic aluminum alloy.

The objects of the invention described above can be achieved by any of the inventions described below.

(1) A superplastic aluminum alloy composed of from 4 to 15% by weight of Mg, from 0.1 to 1.0% by weight of one or more elements selected from the group consisting of mish metal (Mm), Zr, V, W, Ti, Nb, Ca, Co, Mo and Ta and the balance being Al and unavoidable impurities, containing from 0.1 to 4.0% by volume fraction of spheroidal precipitates, which are 10 to 200 nm in particle size, of intermetallic compounds of the elements mentioned above, having a mean grain size from 0.1 to 10 μm, and having a structure containing grain boundaries whose misorientation is less than 15° in an amount from 10 to 50%.

(2) The superplastic aluminum alloy according to (1) described above, wherein the content of said Mg is from 7 to 15% by weight.

(3) The superplastic aluminum alloy according to (1) described above, wherein the content of said Mg is from 4 to less than 7% by weight.

(4) A superplastic aluminum alloy composed of from 7 to 10% by weight of Mg, from 0.1 to 1.0% by weight of mish metal (Mm) and Zr in total with a Mm/Zr ratio from 0.2 to 2.0 and the balance being Al and unavoidable impurities, containing from 0.1 to 4.0% by volume of spheroidal precipitates, which have a particle size from 10 to 200 nm, of intermetallic compounds of the elements mentioned above, and having a structure with a mean grain size from 0.5 to 10 μm.

(5) A superplastic aluminum alloy composed of from 4 to 15% by weight of Mg, from 0.1 to 1.0% by weight of one or more elements selected from the group consisting of mish metal (Mm), Zr, V, W, Ti, Ni, Nb, Ca, Co, Mo and Ta, from 0.005 to 0.1% by weight of Sc and the balance being aluminum and unavoidable impurities, containing from 0.1 to 4.0% by volume fraction of spheroidal precipitates, which have a particle size from 10 to 200 nm, of intermetallic compounds of the elements mentioned above, and having a structure with a mean grain size from 0.1 to 10 μm.

(6) The superplastic aluminum alloy according to (5) described above, wherein the content of said Mg is from 7 to 15% by weight.

(7) The superplastic aluminum alloy according to (5) described above, wherein the content of said Mg is from 4 to less than 7% by weight.

(8) A superplastic aluminum alloy composed of from 4 to 15% by weight of Mg, from 0.1 to 1.0% by weight of one or more elements selected from the group consisting of mish metal (Mm), Zr, V, W, Ti, Ni, Nb, Ca, Co, Mo and Ta, from 0.1 to 2.0% by weight of Cu and/or Li and the balance being aluminum and unavoidable impurities, containing from 0.1 to 4.0% by volume fraction of spheroidal precipitates, which have a particle size from 10 to 200 nm, of intermetallic compounds of the elements mentioned above, and having a structure with a mean grain size from 0.1 to 10 μm.

(9) The superplastic aluminum alloy according to (8) described above, wherein the content of said Mg is from 7 to 15% by weight.

(10) The superplastic aluminum alloy according to (8) described above, wherein the content of said Mg is from 4 to less than 7% by weight.

(11) The superplastic aluminum alloy according to (8) described above, wherein the content of said Mg is from 7 to 15% by weight, and said superplastic aluminum alloy further contains from 0.01 to 0.2% by weight of one or more elements selected from the group consisting of Sn, In and Cd.

(12) The superplastic aluminum alloy according to (8) described above, wherein the content of said Mg is from 4 to less than 7% by weight, and said superplastic aluminum alloy further contains from 0.01 to 0.2% by weight of one or more elements selected from the group consisting of Sn, In and Cd.

(13) A process for producing a superplastic aluminum alloy, comprising the step of melting and casting an aluminum alloy having the composition according to (2) or (4) described above and homogenizing the resultant ingot at a temperature from 300° to 530° C., the step of subjecting the product to first hot working at a temperature from 400° to 530° C. to give a working ratio from 10 to 40%, the step of successively precipitation treatment the resultant product without cooling at a temperature from 400° to 530° C., and the step of subjecting the resultant product to second hot working at a temperature from 300° to 400° C. to give a working ratio of at least 40% in the second hot working alone.

(14) A process for producing a superplastic aluminum alloy, comprising the step of melting and casting an aluminum alloy having the composition according to (3) described above and homogenizing the resultant ingot at a temperature from 230° to 560° C., the step of subjecting the product to first hot working at a temperature from 400° to 560° C. to give a working ratio from 10 to 40%, the step of successively precipitation treatment the resultant product without cooling at a temperature from 400° to 560° C., and the step of subjecting the resultant product to second hot working at a temperature of less than 300° C. to give a working ratio of at least 40% in the second hot working alone.

(15) A process for producing a superplastic aluminum alloy, comprising the step of melting and casting an aluminum alloy having the composition according to (6) described above and homogenizing the resultant ingot at a temperature from 400° to 530° C. for from 8 to 24 hours to make the particle size and volume fraction of spheroidal dispersed particles of intermetallic compounds of the elements mentioned above from 10 to 200 nm and from 0.1 to 4.0%, respectively, and the step of hot working the resultant product at a temperature from 300° to 400° C. to give a working ratio of at least 50% and make the mean grain size from 0.1 to 10 μm.

(16) A process for producing a superplastic aluminum alloy, comprising the step of melting and casting an aluminum alloy having the composition according to (7) described above and homogenizing the resultant ingot at a temperature from 400° to 530° C. for from 8 to 24 hours to make the particle size and volume fraction of spheroidal dispersed particles of intermetallic compounds of the elements mentioned above from 10 to 200 nm and from 0.1 to 4.0%, respectively, and the step of hot working the resultant product at a temperature of less than 300° C. to give a working ratio of at least 50% and make the mean grain size from 0.1 to 10 μm.

(17) A process for producing a superplastic aluminum alloy, comprising the step of melting and casting an aluminum alloy having the composition according to (9) or (11) described above and homogenizing the ingot at a temperature from 400° to 530° C. for a time from 8 to 24 hours, the step of hot working the resultant ingot at a temperature from 400° to 530° C. to give a working ratio from 10 to 40%, the step of precipitation treatment the product at a temperature from 400° to 530° C., and the step of hot working the resultant product at a temperature from 300° to 400° C. to give a working ratio of at least 40% in the last-mentioned hot working alone and subsequently rapidly cooling the product.

(18) A process for producing a superplastic aluminum alloy, comprising the step of melting and casting an aluminum alloy having the composition according to (10) or (12) described above, and homegenizing the ingot at a temperature from 400° to 560° C. for from 8 to 24 hours, the step of hot working the resultant ingot at a temperature from 400° to 560° C. to give a working ratio from 10 to 40%, the step of precipitation treatment the product at a temperature from 400° to 560° C., and the step of hot working the resultant product at a temperature from 200° to 300° C. to give a working ratio of at least 40% and subsequently rapidly cooling the product.

(19) A process for producing a superplastic aluminum alloy, comprising the step of melting and casting an aluminum alloy composed of from 4 to less than 7% by weight of Mg, from 0.1 to 1.0% by weight of one or more elements selected from the group consisting of mish metal (Mm), Zr, V, W, Ti, Nb, Ca, Co, Mo and Ta and the balance being Al and unavoidable impurities, and working the resultant ingot at a temperature of less than 400° C. to give a working ratio of at least 10%, the step of precipitation treatment the product at a temperature from 400° to 560° C. for from 4 to 20 hours, and the step of hot working the resultant product at a temperature of less than 300° C. to give a working ratio of at least 40% in the last-mentioned hot working alone, said superplastic aluminum alloy thus having a controlled structure which contains from 0.1 to 4.0% by volume fraction of spheroidal precipitates composed of intermetallic compounds of the elements mentioned above and having a particle size from 10 to 200 nm, and which has a mean grain size from 0.1 to 10 μm.

BEST MODE FOR PRACTICING THE INVENTION

Figure 1:
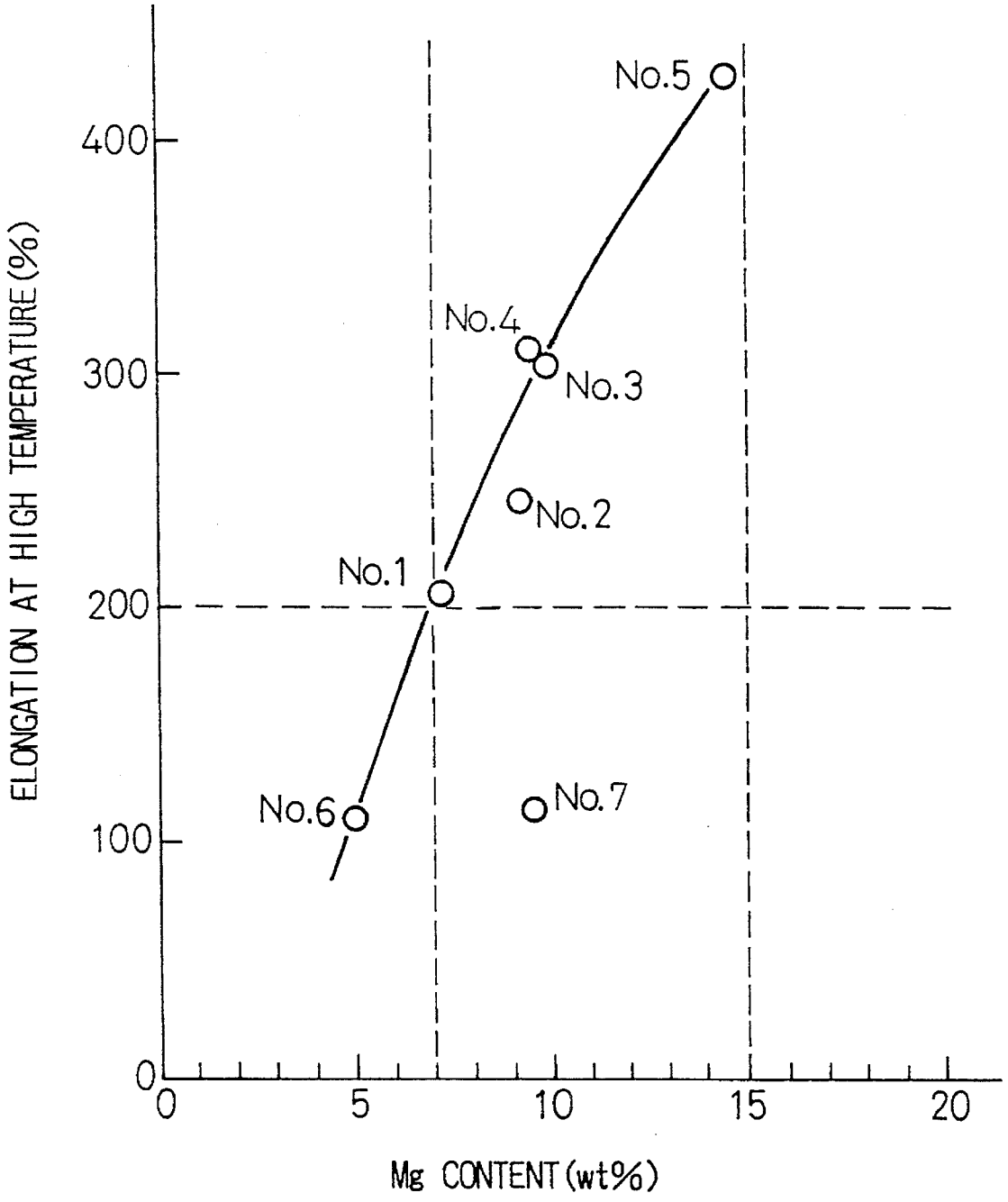
FIG. 1 is a graph showing a relationship between the content of Mg and the elongation at high temperature according to Example 1.

In the present invention, grain structures appropriate for starting dynamic recrystallization is formed in an ingot-made superplastic aluminum alloy by a suitable combination of dislocation inducement caused by hot working and precipitation treatment.

Each of the components of the alloy composition will be illustrated below. Mg is a principal element for improving the strength of the aluminum alloy. The strengthening mechanism is solution hardening and an increase in transgranular deformation resistance due to a decrease in cross-slip caused by stacking fault energy lowering. The strength of grain boundaries at high temperature relatively decreases due to the strengthening mechanism, and smooth grain boundary migration or sliding takes place to exhibit superplasticity* (*elongation by high temperature tensile test being at least 200%). The effect of adding Mg on superplasticity is proportional to the amount of Mg. When the amount is less than 4% by weight, the effect is small. When the amount exceeds 15% by weight, hot working becomes difficult, and the addition of Mg becomes impractical. In addition to Mg, elements such as Cu and Zn, which decrease stacking fault energy of Al, may be expected to produce similar effects.

Mm, Zr, V, W, Ti, Ni, Nb, Ca, Co, Mo and Ta form with Al intermetallic compounds during homogenizing, inhibit grain growth as spheroidal dispersed particles during superplastic deformation, improve superplasticity, and strengthen the alloy at room temperature by precipitation hardening. The effects are small when the total amount of the additional elements is less than 0.1% by weight. When the total amount exceeds 1.0% by weight, coarse intermetallic compounds are crystallized at the time of casting in the conventional ingot-making process and, as a result, the superplasticity is lowered. When a casting method in which the cooling rate is higher than the conventional casting method is employed, the dissolution amount of the additional elements increases, and the superplasticity of the aluminum alloy is improved. However, the shape of ingot (e.g., wall thickness, etc.) is restricted, and the production of the aluminum alloy becomes costly.

In addition, when the addition ratio of Mm/Zr in the composite addition does not fall in the range from 0.2 to 2.0, the effect becomes small. The optimum range is from 0.5 to 1.5.

Sc forms with Al during casting an intermetallic compound as spheroidal dispersed particles. The particles inhibit grain growth during homogenizing and grain growth during superplastic deformation, and as a result improve the superplasticity of the alloy. Moreover, Sc improves the strength of the alloy at room temperature. The effect is small when the amount is less than 0.005% by weight. When the amount becomes at least 0.1% by weight in conventional ingot-making, a coarse intermetallic compound is crystallized, and the superplasticity of the alloy is lowered.

Cu and Li further improve the strength of the superplastic aluminum alloy of the invention by precipitation hardening. The effect is small when the total amount of the elements is less than 0.1% by weight. When the total amount exceeds 2.0% by weight, the strength is improved, but the formability is lowered. Moreover, Cu improves the stress corrosion cracking resistance of the alloy.

Sn, In and Cd inhibit aging at room temperature, decrease secular change, promote aging at high temperature and improve baking hardenability. They also improve pitting corrosion resistance.

The dispersed particles of intermetallic compounds will be described below. The dispersed particles of intermetallic compounds effectively inhibit the grain growth during superplastic deformation and improve the superplasticity of the aluminum alloy when they are spheroidal and have a particle size from 10 to 200 nm and a volume fraction from 0.1 to 4.0%. When these conditions are not satisfied, dislocations induced into the aluminum alloy during hot working cut the dispersed particles or form loops. As a result, the dislocation cell structure is difficult to form, and the inhibition of grain growth becomes difficult. Accordingly, the superplasticity of the aluminum alloy is lowered. The optimum size of the dispersed particles is from 20 to 50 nm. Moreover, the dispersed particles are desirably uniformly dispersed, having a mean free path from 0.05 to 50 μm.

The superplastic aluminum alloy of the present invention desirably have a mean particle size from 0.1 to 10 μm and contain grain boundaries whose misorientation is less than 15° in an amount from 10 to 50%. The superplasticity of the alloy is lowered when the mean particle size exceeds 10 μm, while the crystal growth becomes large and the superplasticity is lowered when the mean grain size is less than 0.1 μm. Those grain boundaries having a grain orientation of less than 15° are shifted to grain boundaries having misorientation of at least 15° by inducing at least one of stress and strain during high temperature deformation. As a result, the aluminum alloy forms a refined grain structure, and exhibits superplasticity at a high strain rate. When the grain structures contain less than 10% of the grain boundaries whose misorientation is less than 15°, the effect is small. When the grain structures contain greater than 50% thereof, many grain boundaries remain without being shifted to grain boundaries having a misorientation of at least 15°. Accordingly, the superplasticity of the aluminum alloy is lowered. The optimum proportion is from 20 to 30%. In addition, boundary sliding easily takes place at grain boundaries having a misorientation of at least 15°. Moreover, the misorientation is obtained by measuring a Kikuchi band in the electron beam diffraction pattern. The proportion, for example, from 10 to 50% is obtained by counting the number of grain structures each of which exhibits a misorientation of less than 15° compared with an adjacent grain on all the grain boundaries in a defined visual field, and calculating the ratio of the number to the total number of the grain boundaries in the visual field.

In the process for producing the superplastic aluminum alloy of the present invention, the aluminum alloy (Mg: 7 to 15% by weight) having such a composition as mentioned above is melted and cast, and the ingot thus obtained is homogenized at a temperature from 300° to 530° C. The homogenizing treatment is satisfactorily carried out in the temperature range between the solution temperature and the solidus line at the composition of the alloy. The optimum temperature thereof is from 400° to 450° C. When the temperature is less than 300° C. (solution temperature at the composition), a coarse compound of Al and Mg is precipitated. Accordingly the alloy exhibits a lowered superplasticity. When the temperature exceeds 530° C. (solidus at the composition), a liquid phase is formed. Accordingly, the alloy exhibits a lowered superplasticity. The homogenizing time is appropriately from 4 to 24 hours. When the homogenizing temperature is low, the homogenizing time becomes long. When the homogenizing temperature is high, the homogenizing time becomes short. The situation is the same with general heat treatment.

After homogenizing, the aluminum alloy is subjected to first hot working at a temperature from 400° to 530° C. to have a working ratio from 10 to 40%, and without lowering the temperature, precipitation treated at a temperature from 400° to 530° C. Dislocation cell structures are formed by the hot working become nucleation sites of precipitates (intermetallic compound particles), and can make the distribution of the precipitates uniform. The precipitation-forming elements diffuse into a dislocation core, and the formation rate of precipitates is accelerated, by setting the hot working temperature at a temperature where the elements are easily diffused. Furthermore, the working induces defects, with the result that the diffusion can be enhanced and the formation rate of precipitations can be accelerated. When the hot working temperature is less than 400° C., precipitation of the dispersed particles is insufficient. When the hot working temperature exceeds 530° C. (solidus at the composition), a liquid phase is formed. Accordingly, the aluminum alloy exhibits lowered superplasticity. The optimum hot working temperature is from 400° to 450° C.

When the working ratio becomes less than 10% or greater than 40%, the dispersion state of the dispersed particles does not satisfy the conditions mentioned above. The optimum working ratio is from 10 to 20%. When the aluminum alloy is not hot worked, refractory soluble crystallized materials and grain boundaries formed by casting mainly become nucleation sites of precipitates. As a result, the distribution of the precipitates becomes nonuniform, and the crystal grains are coarsened.

The aluminum alloy is precipitation treated subsequent to hot working, because the dislocation cell structure having been formed at the first hot working is recovered if the aluminum alloy is heated after cooling. Furthermore, if the aluminum alloy is cooled and allowed to stand at room temperature, the worked structure is recovered by age softening (relaxation of dislocations caused by rearrangement even at room temperature due to high strain energy, or precipitation of a β-phase on dislocations). The dispersed particles are controlled by precipitation treatment to have a particle size distribution range from 10 to 200 nm and a volume fraction from 0.1 to 4.0%. When the temperature is less than 400° C., the growth rate of the dispersed particles becomes low, and the treatment time becomes long. Accordingly the treatment temperature is not practical. When the treatment temperature exceeds 530° C. (solidus at the composition), a liquid phase is formed. Accordingly, the aluminum alloy exhibits a lowered superplasticity. The optimum treatment temperature is from 400° to 450° C. A treatment time from 1 to 4 hours is suitable. The time is determined in the same manner as in the homogenizing treatment.

After precipitation treatment, the aluminum alloy is subjected to second hot working at a temperature from 300° to 400° C. to have a working ratio of at least 40%. Dislocations are induced thereinto by hot working, and uniformly dispersed precipitates (dispersed particles) are tangled with the dislocations, whereby an equiaxed dislocation cell structure is formed. As a result, fine equiaxed particles are formed. Furthermore, the dislocations are rearranged by heating during working to form many small angle tilt grain boundaries (grain boundaries having a misorientation of less than 15°). Moreover, the dislocations are pinned by the precipitates, and the dislocations and the precipitates are piled and tangled with each other. As a result, few of the dislocations climb to other slip planes during holding the aluminum alloy, or get free from the precipitates and migrate. The hot working forms a fine structure which contains from 10 to 50% of grain boundaries having a misorientation of less than 15° and has a mean particle size from 0.5 to 10 μm in the aluminum alloy. When the working temperature exceeds 400° C., the dispersed particles are coarsened to have a particle size of greater than 200 nm, and the aluminum alloy exhibits a lowered superplasticity. When the working temperature is less than 300° C., the fine structure cannot be formed in the aluminum alloy. When the working ratio is less than 40%, the fine structure cannot be formed therein. On the other hand, when the precipitates are not formed, the grain structures are elongated in the working direction, and dislocations climb or migrate to annihilation sites (grain boundaries) during holding the aluminum alloy for hot working. As a result, the dislocation cell structure disappears, and a fine grain structure is not formed.

The grain structure are ordinarily refined by recrystallization after working. However, in the present invention, refined grains are obtained by hot working as described above.

After precipitation treatment, the aluminum alloy is hot worked at a temperature from 300° to 400° C. to have a working ratio of at least 40%. A fine structure having a mean grain size from 0.5 to 10 μm is formed therein by the hot working. When the temperature exceeds 400° C., the dispersed particles are coarsened, and as a result the aluminum alloy exhibits a lowered superplasticity. When the temperature is less than 300° C. (solution temperature at the composition), the fine structure cannot be formed therein. When the working ratio is less than 40%, the fine structure cannot be formed therein.

An aluminum alloy having the composition described above (Mg: from 4 to less than 7% by weight) is melted and cast. The ingot thus obtained is homogenized at a temperature from 230° to 560° C. The homogenizing temperature is satisfactory when the temperature is in the range between the solution temperature and the solidus at the composition. The optimum temperature is from 400° to 450° C. When the homogenizing temperature is less than 230° C. (solution temperature of the composition), a coarse compound of Al and Mg is precipitated, and as a result the aluminum alloy exhibits a lowered superplasticity. When the homogenizing temperature exceeds 560° C. (solidus line at the composition), a liquid phase is formed therein. Accordingly, the aluminum alloy exhibits a lowered superplasticity. After homogenizing treatment, the aluminum alloy is hot worked at a temperature from 400° to 560° C. to have a working ratio from 10 to 40%, and subsequently precipitation treated at a temperature from 400° to 560° C. Spheroidal particles are uniformly dispersed by hot working. When the temperature is less than 400° C., precipitation of the dispersed particles is insufficient. When the temperature exceeds 560° C. (solidus line at the composition), a liquid phase is formed. Accordingly, the aluminum alloy exhibits a lowered superplasticity. The optimum temperature is from 400° to 450° C. After precipitation treatment, the aluminum alloy is hot worked at a temperature of less than 300° C. to have a working ratio of at least 40%. A fine structure having a mean grain size from 0.1 to 10 μm is formed therein by the hot working. When the hot working temperature exceeds 300° C., a dynamic recovery takes place, and the dislocations are decreased. Accordingly, the fine structure cannot be formed therein. When the working ratio is less than 40%, the fine structure cannot be formed therein.

Furthermore, an aluminum alloy having the composition mentioned above (Sc: 0.005 to 0.1% by weight) is melted and cast. The ingot thus obtained is homogenized at a temperature from 400° to 530° C. for 8 to 24 hours, whereby the spheroidal dispersed particles are controlled to have a particle size distribution range from 10 to 200 nm and a volume fraction from 0.1 to 4.0%. When the homogenizing temperature is less than 400° C., precipitation of spheroidal particles containing Mm, Zr, V, W, Ti, Ni, Nb, Ca, Co, Mo and Ta is insufficient. When the homogenizing temperature exceeds 530° C., spheroidal particles containing Sc are coarsened, and as a result the aluminum alloy exhibits a lowered superplasticity. When the homogenizing time is less than 8 hours, the coarse compounds of Al and Mg which have been crystallized during casting are not dissolved at all, and cause cracking subsequent to hot working. Precipitation of the spheroidal dispersed particles containing Mm, Zr, V, W, Ti, Ni, Nb, Ca, Co, Mo and Ta becomes insufficient at the same time. When the homogenizing time is at least 24 hours, spheroidal particles containing Sc are coarsened, whereby the aluminum alloy exhibits a lowered superplasticity. The optimum homogenizing temperature is from 400° to 450° C., and the optimum homogenizing time is from 10 to 20 hours.

When the aluminum alloy contains from 7 to 15% by weight of Mg after homogenizing treatment, it is hot worked at a temperature from 300° to 400° C. to have a working ratio of at least 50%. When the aluminum alloy contains from 4 to less than 7% by weight of Mg after homogenizing treatment, it is hot worked at a temperature of less than 300° C. to have a working ratio of at least 50%. A fine structure having a mean grain size from 0.1 to 10 μm is formed therein by the hot working. When the hot working temperature exceeds the upper limit temperature, the spheroidal dispersed particles are coarsened, and as a result the aluminum alloy exhibits a lowered superplasticity. In the invention, the fine structure cannot be formed therein when the hot working temperature is less than 300° C. When the working ratio is less than 50%, the fine structure cannot be formed therein.

In addition, in an aluminum alloy containing from 7 to 15% by weight of Mg, from 0.1 to 2% by weight of Cu and/or Li, and Sn, In and Cd as selective elements, the procedures to be conducted for the alloy are the same as mentioned above except for a homogenizing temperature from 400° to 530° C. and a homogenizing time from 8 to 24 hours. Moreover, in an aluminum alloy containing from 4 to 7% by weight of Mg, from 0.1 to 2% by weight of Cu and/or Li, and Sn, In and Cd as selective elements, though the procedures to be conducted for the alloy are the same as the invention except for a homogenizing temperature from 400° to 560° C., a homogenizing time from 8 to 24 hours and a second hot working temperature from 200° to 300° C., the aluminum alloy is hot worked after precipitation treatment, at a temperature from at least 200° C. to less than 300° C. to have a working ratio of at least 40%. A fine structure having a mean grain size from 0.1 to 10 μm is formed therein by the hot working. When the hot working temperature is less than 200° C., Cu and Li are precipitated, whereby the aluminum alloy exhibits a deteriorated baking hardenability. When the working temperature exceeds 300° C., a dynamic recovery is produced to decrease dislocations, whereby the fine structure cannot be formed therein. When the working ratio is less than 40%, the fine structure cannot be formed therein.

Rapid cooling is carried out after hot working in both cases. A cooling rate of at least the rate in forced air cooling (at least 15° C./sec) is satisfactory for the rapid cooling. The rapid cooling freezes dislocations and inhibits precipitation of Cu and Li at the same time. The effects are insufficient when the cooling rate is less than 15° C./sec.

The superplastic aluminum alloy obtained by the processes described above is superplastically worked at least at 400° C. and rapidly cooled immediately. When the aluminum alloy is superplastically worked at least at 400° C., Al—Mg intermetallic compounds and Cu and Li are dissolved during the temperature rise and holding. The effect is insufficient when the temperature is less than 400° C. The aluminum alloy is rapidly cooled immediately after superplastic working. The cooling rate is sufficient if it is at least the rate of forced air cooling (at least 15° C./sec). The rapid cooling inhibits precipitation of Cu and Li. The effect is insufficient when the cooling rate is less than 15° C./sec. The superplastically formed and worked body exhibits a further improved strength when coated baking finished.

Furthermore, in the process wherein the homogenizing treatment is shortened, there is obtained an aluminum alloy in which crystallization of the Al—Mg intermetallic compound is inhibited by sufficiently dissolving Mg in the composition, and cooling the alloy ingot at a rate of at least 10° C./sec to solidification. The resultant ingot is worked to have a working ratio of at least 10%. The diffusion of the additional elements is enhanced and the precipitation sites are increased by working. The effect is insufficient when the working ratio is less than 10%. Although the working temperature is desirably the temperature of cold working, a working temperature of less than 400° C. causes no problem when cold working is difficult. When the working temperature becomes at least 400° C., the precipitation sites are decreased, and the effect becomes insufficient.

The aluminum alloy is subsequently precipitation treated at a temperature from 400° to 560° C. for 4 to 20 hours, whereby the spheroidal dispersed particles are controlled to have a particle size distribution range from 10 to 200 nm and a volume fraction from 0.1 to 4.0%. When the treatment temperature is less than 400° C., the growth rate of the dispersed particles is low, and the treatment time becomes long. Accordingly, the treatment temperature is not practical. When the treatment temperature exceeds 560° C. (solidus line at the composition), a liquid phase is formed. Accordingly, the aluminum alloy exhibits a lowered superplasticity. The optimum temperature is from 400° to 450° C.

After the precipitation treatment, the aluminum alloy is hot worked at a temperature of less than 300° C. to have a working ratio of at least 40%, whereby a fine structure having a mean grain size from 0.1 to 10 μm is formed therein. When the hot working temperature exceeds 300° C., a dynamic recovery is produced, and dislocations are decreased, whereby the fine structure cannot be formed therein. When the working ratio is less than 40%, the fine structure cannot be formed therein.

According to the present invention as described above, there may be produced an ingot-made aluminum alloy capable of being used in plastic working such as extrusion and forging, and rolling. Moreover, the superplastic aluminum alloy exhibits superplasticity at a strain rate from $1.0\times10^{-4}$ to 10°/sec at a temperature from 300° to 460° C. in the case of the Mg content being from 7 to 15% by weight and at a temperature from 400° to 500° C. in the case of the Mg content being from 4 to less than 7% by weight.

EXAMPLES

The present invention is illustrated below in detail by making reference to Examples and Comparative Examples while the attached drawings are referred to.

Example 1

Aluminum alloys having compositions according to the 2nd and the 13th inventions as shown in Table 1 (Samples No. 1 to No. 5 in Example and Samples No. 6 to No. 9 in Comparative Example) were each melted and cast to give ingots.

TABLE 1

| | Sample No. | Mg | Zr | Mm | Ti | Cr | Fe | Si | Mn | Cu | Zn | (wt. %) Al |
|---|---|---|---|---|---|---|---|---|---|---|---|---|
| Ex. | 1 | 7.1 | — | 0.22 | — | — | 0.08 | 0.05 | 0.01 | 0.01 | 0.01 | Bal. |
| | 2 | 9.2 | — | 0.29 | — | — | 0.08 | 0.05 | 0.01 | 0.01 | 0.01 | Bal. |
| | 3 | 9.9 | 0.12 | — | — | — | 0.08 | 0.05 | 0.01 | 0.01 | 0.01 | Bal. |
| | 4 | 9.3 | 0.23 | — | — | — | 0.08 | 0.05 | 0.01 | 0.01 | 0.01 | Bal. |
| | 5 | 14.7 | 0.13 | — | — | — | 0.08 | 0.05 | 0.01 | 0.01 | 0.01 | Bal. |
| Comp. | 6 | 5.0 | — | — | 0.15 | 0.05 | 0.40 | 0.40 | 0.40 | 0.01 | 0.01 | Bal. |
| Ex. | 7 | 9.7 | — | — | — | — | 0.01 | 0.01 | 0.01 | 0.01 | 0.01 | Bal. |
| | 8 | 9.8 | 1.5 | — | — | — | 0.01 | 0.01 | 0.01 | 0.01 | 0.01 | Bal. |
| | 9 | 18.3 | 0.11 | — | — | — | 0.08 | 0.05 | 0.01 | 0.01 | 0.01 | Bal. |

In addition, Mn, Fe, Si, Cu and Zn in Table 1 were impurities in the present invention. These ingots were homogenized at 440° C. for 24 hours, hot swaged at 440° C. to have a working ratio of 10%, subsequently precipitation treated at 440° C. for 1 hour, then water cooled from the precipitation treatment temperature, hot swaged at 300° C. to have a working ratio of 40%, and water cooled to obtain ingot-made superplastic aluminum alloys.

Test pieces each having a parallel portion (diameter 5 mm×length 15 mm) were taken from the resultant superplastic aluminum alloy products and tensile tested at a temperature from 300° to 500° C. at a strain rate from $5.5\times10^{-4}$ to $1.1\times10^{-1}$ $sec^{-1}$.

The results thus obtained are shown in FIG. 1. Samples No. 1 to No. 5 of the superplastic aluminum alloy products according to the present invention exhibited a superplastic elongation of at least 200%. Sample No. 6 of the aluminum alloy product in Comparative Example could not be sufficiently solution hardened due to an inadequate content of Mg, and did not exhibit superplasticity. Since Sample No. 7 in Comparative Example did not contain fine spheroidal dispersed particles, grain growth took place during deformation at high temperature. As a result, Sample No. 7 did not exhibit superplasticity. Since coarse intermetallic compounds were crystallized in Sample No. 8 and defects were formed during hot working, a test piece was not taken, and the test was stopped. Since Sample No. 9 contained a large amount of Mg, cracks were formed during hot working. The subsequent tensile test was therefore stopped. Moreover, the aluminum alloy of Sample No. 2 in Table 1 was melted and cast in the same manner as described above. The resultant aluminum ingots were heat treated and worked under the conditions shown in Table 2. The resultant aluminum alloy products were tested in the same manner as in Example 1.

TABLE 2

| | Sample No. | Homog. temp. (°C.) | 1st Hot working Temp. (°C.) | 1st Hot working Working ratio (%) | Precip. treat. temp. (°C.) | 2nd Hot working Temp. (°C.) | 2nd Hot working Working ratio (%) | High temp. elong. (%) |
|---|---|---|---|---|---|---|---|---|
| Ex. | 10 | 440 | 440 | 10 | 440 | 300 | 40 | 240 |
| | 11 | 440 | 440 | 40 | 440 | 300 | 40 | 260 |
| | 12 | 440 | 440 | 10 | 440 | 300 | 90 | 390 |
| Comp. | 13 | 550 | Test after homogenizing being stopped* | | | | | |
| Ex. | 14 | 250 | 440 | 10 | 440 | 300 | 40 | — |
| | 15 | 440 | 440 | 10 | 440 | 300 | 30 | 180 |
| | 16 | 440 | 300 | 10 | 440 | 300 | 40 | 170 |
| | 17 | 440 | 550 | 10 | — | — | — | — |
| | 18 | 440 | 440 | 10 | 440 | 500 | 40 | 120 |
| | 19 | 440 | 440 | 10 | 440 | 200 | — | — |
| | 20 | 440 | 440 | 10 | 300 | 300 | 40 | 110 |
| | 21 | 440 | 440 | 10 | 500 | 300 | 40 | 130 |

Note:
Homog. temp. = Homogenizing temperature
Precip. treat. = Precipitation treatment
*The test was stopped because a liquid phase had been formed in the ingot.

Samples No. 10 to No. 12 of the superplastic aluminum alloy products according to the present invention exhibited a superplasticity of at least 200%. Since the homogenizing temperature of Sample No. 13 in Comparative Example was high, a liquid phase was produced within the ingot. The subsequent test was therefore stopped. Since the homogenizing temperature of Sample No. 14 was low, crystallized b-phase did not dissolve sufficiently, and defects were formed during hot working. Accordingly, the test piece was not taken, and the test was stopped. Since the working ratio of the second hot working (swaging) was low in Sample No. 15, the recrystallized grains were coarsened, and the sample did not exhibit superplasticity. Since the temperature of the first hot working (swaging) was low in Sample No. 16, sufficiently fine spheroidal dispersed particles could not be obtained, and the grain structures were coarsened during deformation at high temperature. Accordingly, Sample No. 16 did not exhibit superplasticity. Since the temperature of the first hot working was high in Sample No. 17, defects were formed during hot working. The subsequent test was therefore stopped. Since the temperature of the second hot working was high in Sample No. 18, a coarsened grain structure was formed, and the sample did not exhibit superplasticity. Since the temperature of the second hot working was low in Sample No. 19, cracks were formed during working, and the test was stopped. Since the aging temperature was low in Sample No. 20, satisfactory precipitates could not be obtained, and grain structures were coarsened during hot working at high temperature. Accordingly, the sample did not exhibit superplasticity. Since the aging temperature was high in Sample No. 21, coarsened dispersed particles were formed and became a hindrance to boundary sliding. Accordingly, the sample did not exhibit superplasticity.

Example 2

Aluminum alloys having compositions according to the 4th or the 13th invention as shown in Table 3 were melted and cast to obtain ingots. The ingots were homogenized at 440° C. for 24 hours.

TABLE 3

| | Sample No. | Chemical composition (wt. %) Mg | Zr | Mm | Fe | Si | Al | Mm/Zr | High temp. elongation (%) |
|---|---|---|---|---|---|---|---|---|---|
| Ex. | 22 | 10.2 | 0.18 | 0.12 | 0.08 | 0.05 | Bal. | 0.67 | 220 |
| | 23 | 9.4 | 0.15 | 0.16 | 0.08 | 0.05 | Bal. | 1.07 | 210 |
| | 24 | 10.4 | 0.11 | 0.19 | 0.08 | 0.05 | Bal. | 1.73 | 210 |
| Comp. | 25 | 9.3 | 0.12 | — | 0.08 | 0.05 | Bal. | 0 | 300 |
| Ex. | 26 | 9.2 | — | 0.29 | 0.08 | 0.05 | Bal. | 0 | 220 |
| | 27 | 9.7 | 0.12 | 0.34 | 0.08 | 0.05 | Bal. | 2.83 | 210 |
| | 28 | 9.6 | 0.03 | 0.04 | 0.07 | 0.04 | Bal. | 1.33 | 140 |
| | 29 | 9.8 | 0.47 | 0.78 | 0.07 | 0.04 | Bal. | 1.63 | Test stopped |
| | 30 | 5.0 | 0.17 | 0.11 | 0.07 | 0.04 | Bal. | 0.65 | 120 |
| | 31 | 17.1 | 0.19 | 0.12 | 0.07 | 0.04 | Bal. | 0.63 | Test stopped |

The resultant ingots were then hot swaged at 440° C. to have a working ratio of 10%, precipitation treated at 440° C. for one hour, hot swaged at 300° C. to have a working ratio of 40%, and water cooled to obtain ingot-made superplastic aluminum alloy products of high strength.

Test pieces each having a parallel portion 5 mm in diameter and 15 mm in length were taken from the superplastic products, heat treated at 400° C. for 30 minutes, and tensile tested by stretching at room temperature at a cross head speed of 1 mm/min to examine the mechanical properties. Test pieces each having a parallel portion 5 mm in diameter and 15 mm in length were taken from the superplastic products, and subjected to high temperature tensile testing at a temperature from 300° to 500° C. at a strain rate from $5.5\times10^{-4}$ to $1.1\times10^{-1}$/sec to examine the superplasticity.

Figure 2:
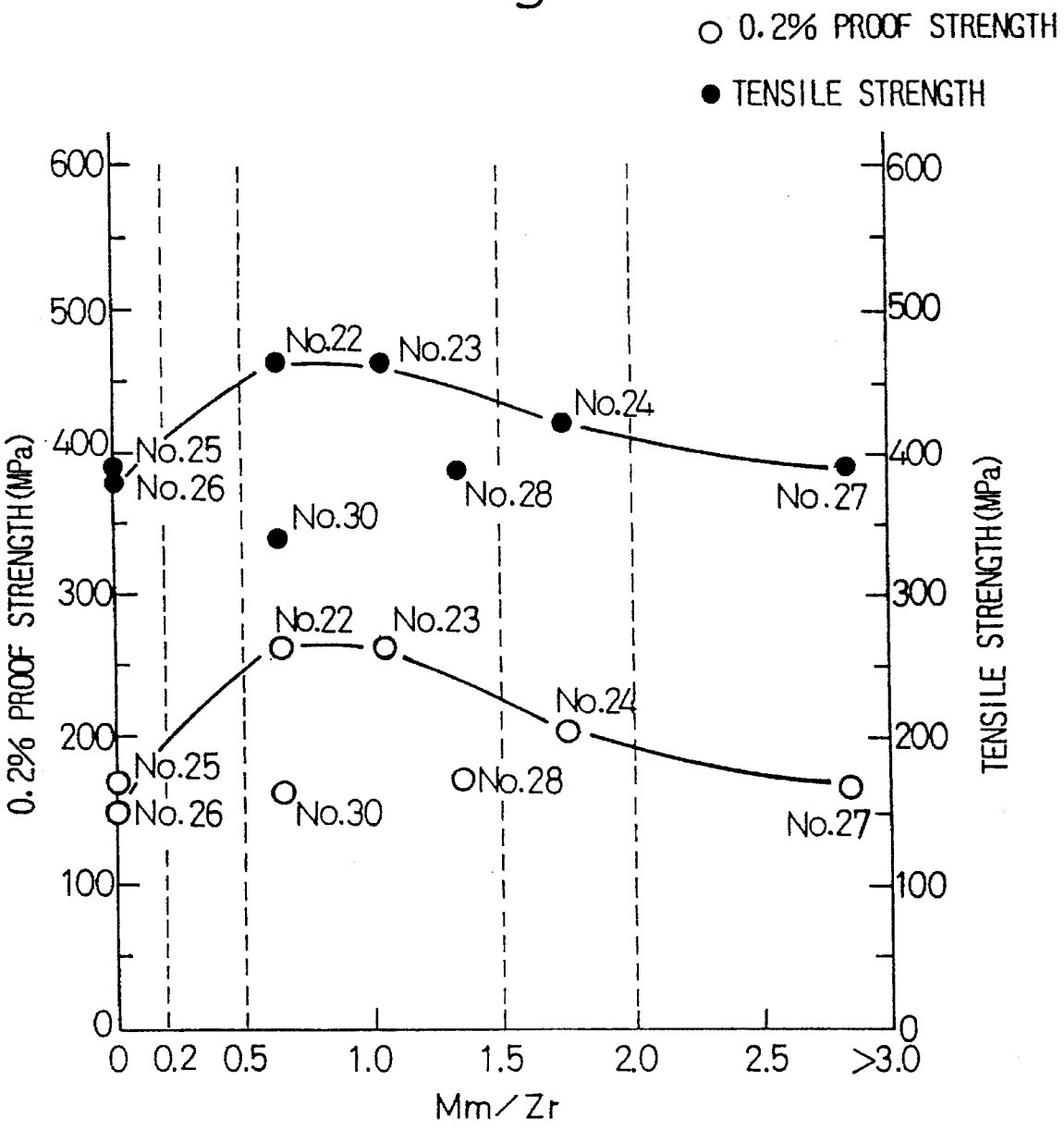
FIG. 2 is a graph showing a relationship between the component ratio of mish metal (Mm) to Zr and the tensile strength and 0.2% proof stress according to Example 2.
Figure 3:
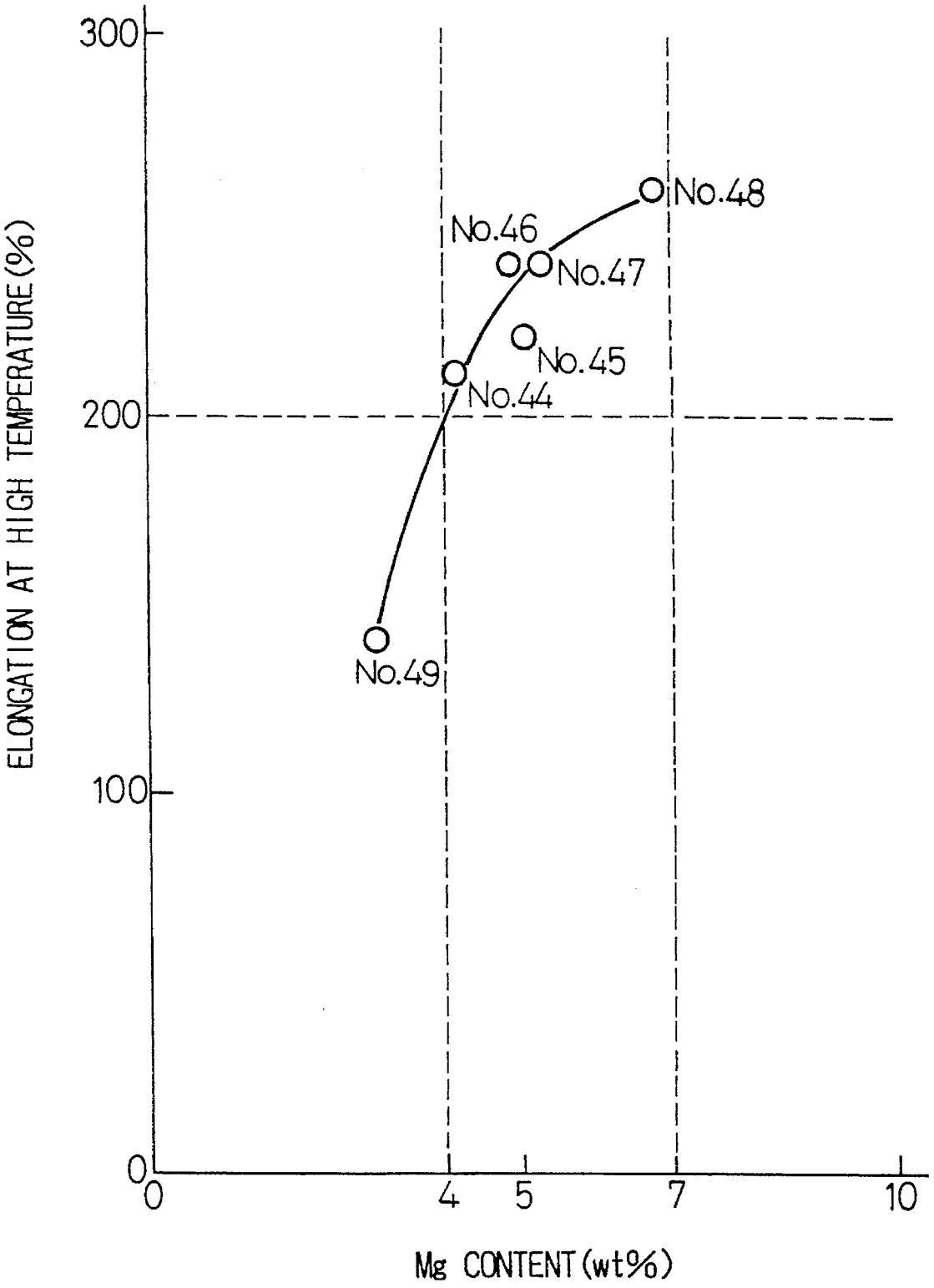
FIG. 3 is a graph showing a relationship between the content of Mg and the elongation at high temperature according to Example 3.

The results thus obtained are shown in FIG. 2. High strength products having a 0.2% proof stress of at least 200 MPa was obtained from Samples No. 22 to No. 24 which were examples of the invention. The samples exhibited a superplastic elongation of at least 200%. Samples No. 25 and No. 26 of comparative examples did not exhibit the strengthening effect of the composite addition, and high strength products could not be obtained. Sample No. 27 did not exhibit the effect of composite addition, and a high strength product could not be obtained. Since sufficiently fine dispersed particles could not be obtained in Sample No. 28, the grain structures were coarsened during deformation at high temperature. Accordingly, the sample did not exhibit superplasticity. Coarse intermetallic compounds were crystallized in Sample No. 29, and defects were formed during hot working. The test was therefore stopped. Since Sample No. 30 contained Mg in a small amount, the sample was not sufficiently solution strengthened. Accordingly, the sample did not exhibit superplasticity. Since Sample No. 31 contained a large amount of Mg, cracks were formed during hot working. Accordingly, the test was stopped.

Furthermore, an aluminum alloy having a composition of Sample No. 22 in Table 3 was subjected to ingot-making in the same manner as described above, and worked and heat treated under the conditions as shown in Table 4.

TABLE 4

| | Sample No. | Homog. temp. (°C.) | 1st Hot working Temp. (°C.) | 1st Hot working Working ratio (%) | Precip. treat. temp. (°C.) | 2nd Hot working Temp. (°C.) | 2nd Hot working Working ratio (%) | High temp. elong. (%) |
|---|---|---|---|---|---|---|---|---|
| Ex. | 32 | 440 | 440 | 10 | 440 | 300 | 40 | 220 |
| | 33 | 440 | 440 | 40 | 440 | 300 | 40 | 230 |
| | 34 | 440 | 440 | 10 | 440 | 300 | 90 | 320 |
| Comp. | 35 | 550 | | | Test stopped | | | |
| Ex. | 36 | 250 | 440 | 10 | 440 | 300 | 40 | — |
| | 37 | 440 | 440 | 10 | 440 | 300 | 30 | 130 |
| | 38 | 440 | 300 | 10 | 440 | 300 | 40 | 110 |
| | 39 | 440 | 550 | 10 | | Test stopped | | |
| | 40 | 440 | 440 | 10 | 440 | 500 | 40 | 120 |
| | 41 | 440 | 440 | 10 | 440 | 200 | Test stopped | |
| | 42 | 440 | 440 | 10 | 300 | 300 | 40 | 100 |
| | 43 | 440 | 440 | 10 | 500 | 300 | 40 | 140 |

Note:
Homog. temp. = Homogenizing temperature
Precip. treat. = Precipitation treatment The superplastic products thus obtained were tested in the same manner as described above. Samples No. 32 to No. 34 which were examples exhibited a superplastic elongation of at least 200%. Since the homogenizing temperature of Sample No. 35 which was a comparative example was high, a liquid phase was formed in the ingot. Accordingly, the subsequent test was stopped. Since the homogenizing temperature of Sample No. 36 was low, a crystallized β-phase did not sufficiently dissolve. As a result, defects were formed during hot working, and the subsequent test was stopped. The working ratio of the second hot working of Sample No. 37 was low and coarse recrystallized grains were formed. As a result, the sample did not exhibit superplasticity. Since the temperature of the first hot working of Sample No. 38 was low, sufficiently fine dispersed particles could not be obtained. As a result, the grain structures were coarsened during deformation at high temperature, and the sample did not exhibit superplasticity. Since the temperature of the first hot working of Sample No. 39 was high, defects were formed during working. Accordingly, the subsequent test was stopped. Since the temperature of the second hot working of Sample No. 40 was high, the grain structure became coarse. Accordingly, the sample did not exhibit superplasticity. Since the temperature of the second hot working of Sample No. 41 was low, cracks were formed during working. Accordingly, the subsequent test was stopped. Since the aging temperature of Sample No. 42 was low, sufficiently fine dispersed particles could not be obtained, and the grain structures were coarsened during deformation at high temperature. As a result, the sample did not exhibit superplasticity. Since the aging temperature of Sample No. 43 was high, the dispersed particles were coarsened and became a hindrance to boundary sliding. Accordingly, the sample did not exhibit superplasticity.

Example 3

Aluminum alloys having compositions according to the 3rd or the 14th invention as shown in Table 5 were melted and cast. The ingots thus obtained were homogenized at 440° C. for 24 hours.

TABLE 5

| | Sample | Chemical composition (wt. %) | | | | | | | | | Intermetallic compound particle size | grain structures | | High temp. elongation |
|---|---|---|---|---|---|---|---|---|---|---|---|---|---|---|
| | | | | | | | | | | | | Particle | Proportion of grain boundaries having misorientation | |
| | No. | Mg | Zr | Mm | Fe | Si | Cu | Mn | Ti | Al | (nm) | size (μm) | <15° (%) | (%) |
| Ex. | 44 | 4.2 | — | 0.12 | 0.08 | 0.05 | 0.01 | 0.01 | — | Bal. | 170 | 6.0 | 12 | 210 |
| | 45 | 5.1 | — | 0.19 | 0.08 | 0.05 | 0.01 | 0.01 | — | Bal. | 150 | 5.0 | 15 | 220 |
| | 46 | 4.9 | 0.20 | — | 0.08 | 0.05 | 0.01 | 0.01 | — | Bal. | 40 | 3.0 | 20 | 240 |
| | 47 | 5.3 | 0.32 | — | 0.08 | 0.05 | 0.01 | 0.01 | — | Bal. | 50 | 2.5 | 25 | 240 |
| | 48 | 6.8 | 0.21 | — | 0.08 | 0.05 | 0.01 | 0.01 | — | Bal. | 40 | 1.5 | 23 | 260 |
| Comp. | 49 | 3.2 | — | — | 0.20 | 0.40 | 0.04 | 0.01 | 0.12 | Bal. | 150 | 7.0 | 10 | 140 |
| Ex. | 50 | 5.1 | — | — | 0.08 | 0.05 | 0.01 | 0.01 | — | Bal. | — | 130 | 3 | 100 |
| | 51 | 4.8 | 1.47 | — | 0.08 | 0.05 | 0.01 | 0.01 | — | Bal. | 1500 | — | — | — |
| | 52 | 7.1 | 0.18 | — | 0.08 | 0.05 | 0.01 | 0.01 | — | Bal. | 40 | — | — | — |

The resultant ingots were hot swaged at 400° C. to have a working ratio of 10%, and subsequently precipitation treated at 400° C. for one hour, hot swaged at 200° C. to have a working ratio of 40%, and water cooled to obtain ingot-made superplastic aluminum alloy products of high strength.

Test pieces each having a parallel portion 5 mm in diameter and 15 mm in length were taken from the superplastic products, and subjected to high temperature tensile test at a temperature from 300° to 500° C. at a strain rate from $5.5\times10^{-4}$ to $1.1\times10^{-1}$/sec.

The results thus obtained are shown in FIGS. 3 to 6. Samples No. 44 to No. 48 exhibited a superplastic elongation of at least 200%. Since Sample No. 49 which was a comparative example contained an insufficient amount of Mg, the alloy could not be sufficiently solution strengthened. Accordingly, the sample did not exhibit superplasticity. Since Sample No. 50 contained no fine spheroidal dispersed particles, grain growth took place during deformation at high temperature. Accordingly, the sample did not exhibit superplasticity. Since Sample No. 51 crystallized coarse intermetallic compounds, defects were formed during hot working. Accordingly, the subsequent test was stopped. Since Sample No. 52 contained a large amount of Mg, cracks were formed during hot working. Accordingly, the subsequent test was stopped.

An aluminum alloy having the composition of Sample No. 45 in Table 5 was subjected to ingot-making in the same manner as described above, and worked and heat treated under the conditions shown in Table 6.

TABLE 6

| | Sample No. | Homog. temp. (°C.) | 1st Hot working Temp. (°C.) | 1st Hot working Working ratio (%) | Precip. treat. temp. (°C.) | 2nd Hot working Temp. (°C.) | 2nd Hot working Working ratio (%) |
|---|---|---|---|---|---|---|---|
| Ex. | 53 | 440 | 400 | 10 | 400 | 200 | 40 |
| | 54 | 440 | 400 | 40 | 400 | 200 | 40 |
| | 55 | 440 | 400 | 10 | 400 | 200 | 90 |
| | 56 | 440 | 400 | 10 | 400 | 25 | 50 |
| Comp. | 57 | 580 | Test after homogenizing being stopped* | | | | |
| Ex. | 18 | 150 | 400 | 10 | Test after hot working being stopped** | | |
| | 59 | 440 | 400 | 10 | 400 | 200 | 30 |
| | 60 | 440 | 300 | 10 | 400 | 200 | 40 |
| | 61 | 440 | 580 | 10 | Test after hot working being stopped*** | | |
| | 62 | 440 | 400 | 10 | 400 | 350 | 40 |
| | 63 | 440 | 400 | 10 | 300 | 200 | 40 |
| | 64 | 440 | 400 | 10 | 500 | 200 | 40 |

| | Sample No. | Intermetallic compound particle size (nm) | Grain structures: Particle size (μm) | Grain structures: Proportion of grain boundaries having misorientation <15° (%) | High temp. elongation (%) |
|---|---|---|---|---|---|
| Ex. | 53 | 150 | 5.0 | 15 | 220 |
| | 54 | 130 | 3.0 | 16 | 230 |
| | 55 | 150 | 0.3 | 41 | 310 |
| | 56 | 150 | 0.5 | 47 | 280 |
| Comp. | 57 | — | — | — | — |
| Ex. | 18 | — | — | — | — |
| | 59 | 150 | 70 | 6 | 140 |
| | 60 | 100 | 80 | 6 | 130 |

TABLE 6-continued

| | | | | |
|---|---|---|---|---|
| 61 | — | — | — | — |
| 62 | 150 | 110 | 4 | 110 |
| 63 | 120 | 20 | 10 | 140 |
| 64 | 280 | 15 | 11 | 150 |

Note:
Homog. temp. = Homogenizing temperature
Precip. treat. = Precipitation treatment
*The test was stopped because a liquid phase had formed in the ingot during homogenizing treatment.
**The test was stopped because cracks had formed during hot working.
***The test was stopped because blisters had formed during hot working.

Figure 4:
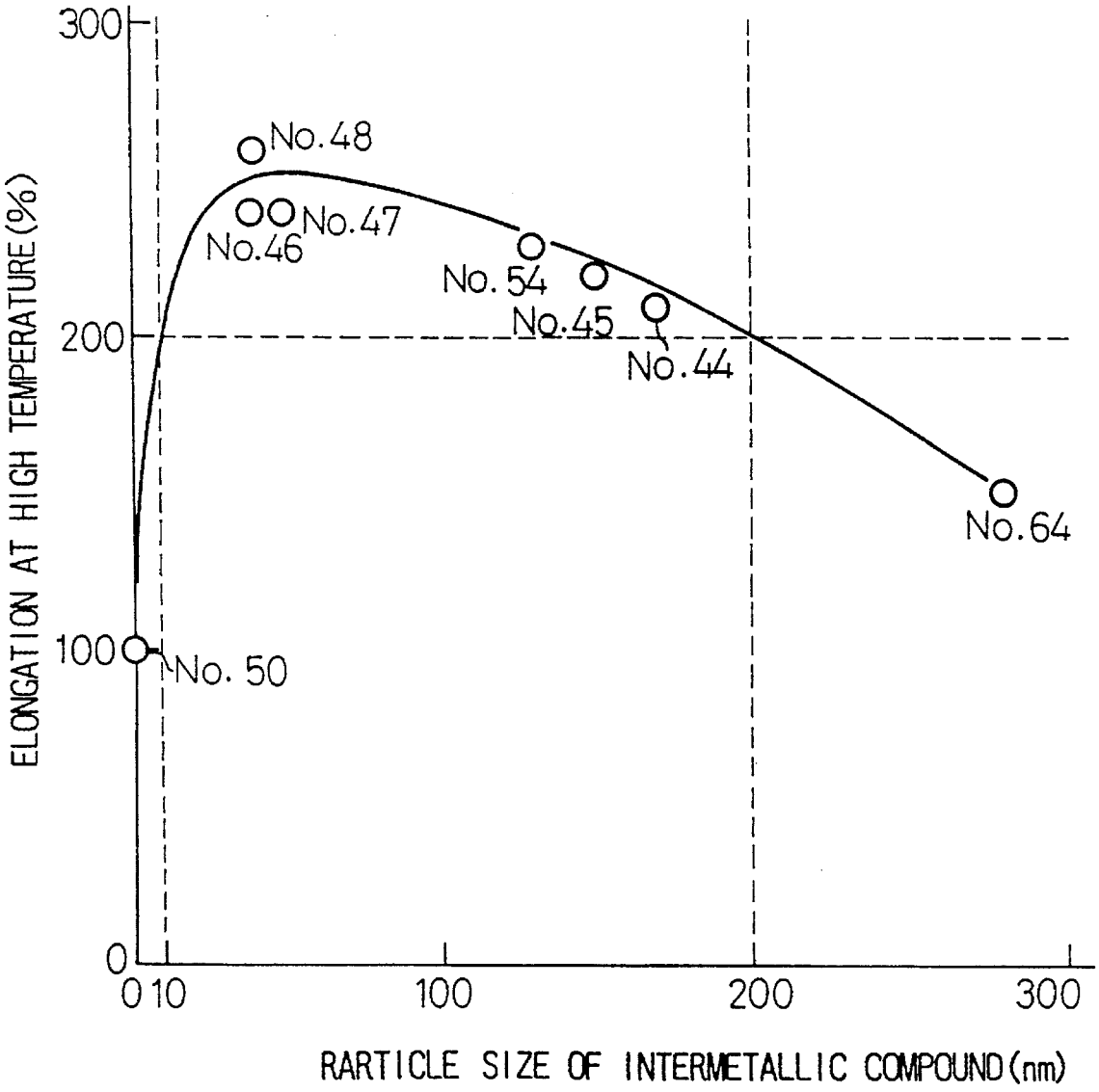
FIG. 4 is a graph showing a relationship between the particle size of intermetallic compounds and the elongation at high temperature according to Example 3.
Figure 5:
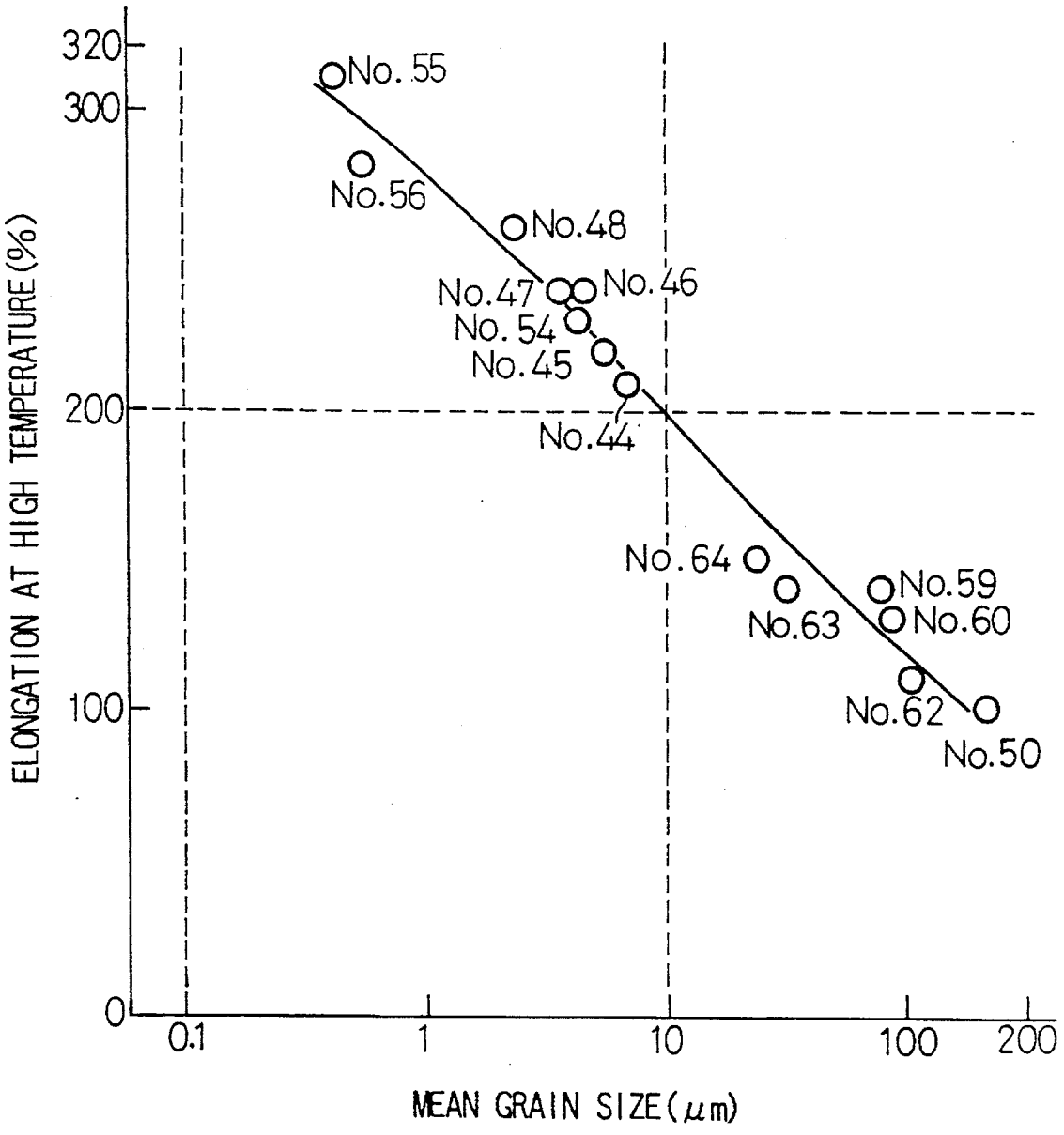
FIG. 5 is a graph showing a relationship between the mean grain size and the elongation at high temperature according to Example 3.
Figure 6:
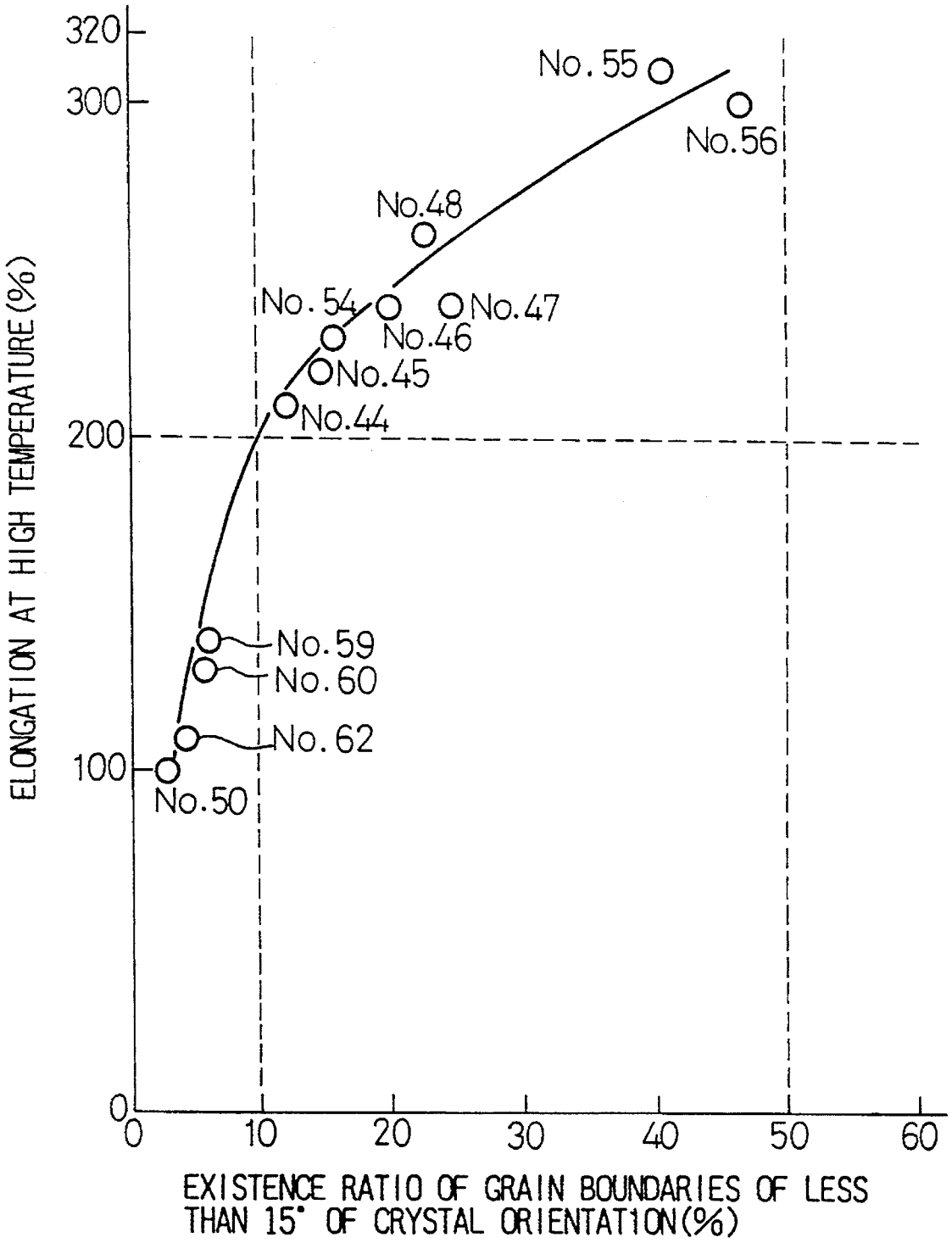
FIG. 6 is a graph showing a relationship between the proportion of grain boundaries having a misorientation of less than 15° and the elongation at high temperature according to Example 3.
Figure 7:
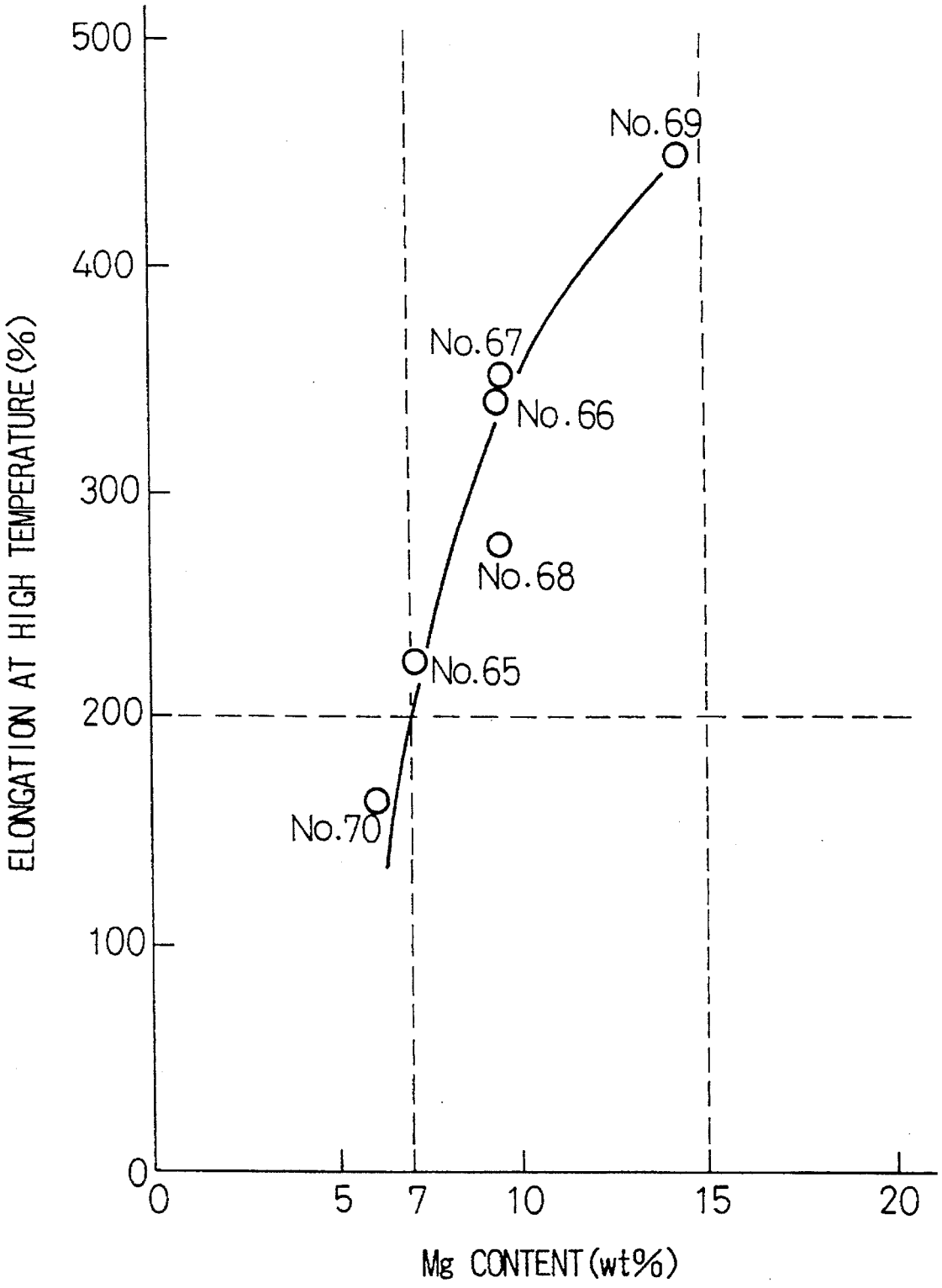
FIG. 7 is a graph showing the content of Mg and the elongation at high temperature according to Example 4.

The superplastic products thus obtained were tested in the same manner as described above. The results thus obtained are shown in FIGS. 4 to 6. Samples No. 53 to 56 exhibited a superplastic elongation of at least 200%. Since the homogenizing temperature of Sample No. 57 which was a comparative example was high, a liquid phase was formed in the ingot. Accordingly, the subsequent test was stopped. Since the homogenizing temperature of Sample No. 18 was low, a crystallized β-phase did not sufficiently dissolve, and defects were formed during hot working. Accordingly, the subsequent test was stopped. Since the working ratio of the second hot working of Sample No. 59 was low, coarse recrystallized grains were formed. Accordingly, the sample did not exhibit superplasticity. Since the temperature of the first hot working of Sample No. 60 was low, sufficiently fine dispersed particles could not be obtained. As a result grain structures were coarsened during deformation at high temperature and, accordingly, the sample did not exhibit superplasticity. Since the temperature of the first hot working of Sample No. 61 was high, defects were formed during working. Accordingly, the subsequent test was stopped. Since the temperature of the second hot working of Sample No. 62 was high, the grain structure became coarse. Accordingly, the sample did not exhibit superplasticity. Since the aging temperature of Sample No. 63 was low, sufficiently fine dispersed particles could not be obtained. As a result, grain coarsening took place during deformation at high temperature. Accordingly, the sample did not exhibit superplasticity. Since the aging temperature of Sample No. 64 was high, the dispersed particles were coarsened and became a hindrance to boundary sliding. Accordingly, the sample did not exhibit superplasticity.

Example 4

Aluminum alloys having compositions according to the 6th and the 15th invention as shown in Table 7 were melted and cast. The ingots thus obtained were homogenized at 440° C. for 16 hours.

TABLE 7

| | Sample | Chemical composition (wt. %) | | | | | | | | | Size of dispersed particles | Grain size | High temp. elongation | Proportion of grain boundaries having Misorientation |
|---|---|---|---|---|---|---|---|---|---|---|---|---|---|---|
| | No. | Mg | Sc | Zr | Mm | Fe | Si | Cu | Mn | Al | (nm) | (μm) | (%) | <15° (%) |
| Ex. | 65 | 7.2 | 0.011 | 0.12 | — | 0.08 | 0.05 | 0.01 | 0.01 | Bal. | 50 | 7.0 | 220 | 13 |
| | 66 | 9.4 | 0.007 | 0.13 | — | 0.08 | 0.05 | 0.01 | 0.01 | Bal. | 50 | 3.0 | 340 | 26 |
| | 67 | 9.5 | 0.08 | 0.12 | — | 0.08 | 0.05 | 0.01 | 0.01 | Bal. | 60 | 2.5 | 350 | 28 |
| | 68 | 9.4 | 0.012 | — | 0.21 | 0.08 | 0.05 | 0.01 | 0.01 | Bal. | 170 | 6.0 | 270 | 17 |
| | 69 | 14.3 | 0.008 | 0.11 | — | 0.08 | 0.05 | 0.01 | 0.01 | Bal. | 50 | 1.0 | 450 | 35 |
| Comp. | 70 | 6.1 | 0.013 | 0.12 | — | 0.08 | 0.05 | 0.01 | 0.01 | Bal. | 50 | 9.0 | 160 | 15 |
| Ex. | 71 | 9.6 | — | 0.12 | — | 0.08 | 0.05 | 0.01 | 0.01 | Bal. | 10 | 15.0 | 170 | 17 |
| | 72 | 9.5 | 0.13 | 0.11 | — | 0.08 | 0.05 | 0.01 | 0.01 | Bal. | 250 | 40.0 | 130 | 11 |
| | 73 | 9.7 | 0.011 | 1.2 | — | 0.08 | 0.05 | 0.01 | 0.01 | Bal. | Test after working stopped* | | | — |
| | 74 | 16.1 | 0.009 | 0.10 | — | 0.08 | 0.05 | 0.01 | 0.01 | Bal. | Test after working stopped** | | | — |
| | 75 | 9.5 | — | — | — | 0.08 | 0.05 | 0.01 | 0.01 | Bal. | — | 140 | 100 | 3 |
| | 76 | 9.5 | 0.011 | — | — | 0.08 | 0.05 | 0.01 | 0.01 | Bal. | 50 | 30.0 | 140 | 4 |

Note:
*The test was stopped because defects had been formed during working.
**The test was stopped because cracks had been formed during working.

After homogenizing treatment, the resultant ingots were hot swaged at 300° C. to have a working ratio of 50%, and water cooled to obtain ingot-made superplastic aluminum alloys.

Test pieces each having a parallel portion 5 mm in diameter and 15 mm in length were taken, and subjected to high temperature tensile test at a temperature from 300° to 500° C. at a strain rate from $5.5\times10^{-4}$ to $1.1\times10^{-1}$/sec.

The results thus obtained were shown in FIGS. 7 to 10. Samples No. 65 to 69 exhibited a superplastic elongation of at least 200%. Since Sample No. 70 contained an insufficient amount of Mg, the sample was not sufficiently solution strengthened. Accordingly, the sample did not exhibit superplasticity. Since Sample No. 71 contained no Sc, grain growth took place during homogenizing treatment, and a fine grain structure could not be formed by subsequent hot working. Accordingly, the sample did not exhibit superplasticity. Since coarse intermetallic compounds of Sc were crystallized in Sample No. 72, the inhibition of grain growth during high temperature deformation became difficult. As a result, the grain structures were coarsened, and the sample did not exhibit superplasticity. Since coarse intermetallic compounds were crystallized in Sample No. 73, defects were formed during hot working. Accordingly, the subsequent test was stopped. Since Sample No. 74 contained a large amount of Mg, cracks were formed during hot working. Accordingly, the subsequent test was stopped. Since Sample No. 75 contained no fine spheroidal dispersed particles, grain growth took place during high temperature deformation. Accordingly, the sample did not exhibit superplasticity. Since Sample No. 76 did not contain sufficient fine spheroidal dispersed particles, grain growth took place during high temperature deformation. Accordingly, the sample did not exhibit superplasticity.

An aluminum alloy having the composition shown in Sample No. 66 was subjected to ingot-making in the same manner as described above, and worked and heat treated under the conditions shown in Table 8.

and sufficient dispersed particles could not be obtained. As a result, the inhibition of grain growth during high temperature deformation became difficult, and the grain structures were coarsened. Accordingly, the sample did not exhibit superplastic deformation. Since the homogenizing time of Sample No. 87 was long, the dispersed particles were coarsened. As a result, the inhibition of grain growth during high temperature deformation became difficult, and the grain structures were coarsened. As a result, the sample did not exhibit superplasticity. Since the hot working temperature of Sample No. 88 was low, defects were formed during working. Accordingly, the subsequent test was stopped. Since the hot working temperature of Sample No. 89 was high, the grain structure was coarsened. Accordingly, the sample did not exhibit superplasticity. Since the working ratio of hot working of Sample No. 90 was low, the grain structure was coarsened. Accordingly, the sample did not exhibit superplasticity.

TABLE 8

| | Sample No. | Homogenizing Temp. (°C.) | Homogenizing Time (hr) | Hot working Temp. (°C.) | Hot working Working ratio (%) | Size of dispersed particles (nm) | Grain size (μm) | High temp. elong (%) | Proportion of grain boundaries having mis-orientation <15° (%) |
|---|---|---|---|---|---|---|---|---|---|
| Ex. | 77 | 440 | 16 | 300 | 50 | 50 | 3.0 | 340 | 26 |
| | 78 | 400 | 16 | 300 | 50 | 30 | 3.5 | 320 | 24 |
| | 79 | 500 | 16 | 300 | 50 | 100 | 5.5 | 300 | 18 |
| | 80 | 440 | 10 | 300 | 50 | 20 | 4.0 | 320 | 23 |
| | 81 | 440 | 20 | 300 | 50 | 90 | 5.0 | 310 | 20 |
| | 82 | 440 | 16 | 300 | 90 | 50 | 0.5 | 430 | 47 |
| | 83 | 440 | 16 | 400 | 50 | 50 | 8.0 | 210 | 13 |
| Comp. | 84 | 550 | Test stopped after homogenizing* | | | | | | — |
| Ex. | 85 | 300 | 16 | 300 | Test stopped after working** | | | | — |
| | 86 | 440 | 5 | 300 | 50 | 8 | 10.0 | 160 | 7 |
| | 87 | 440 | 30 | 300 | 50 | 220 | 25.0 | 150 | 5 |
| | 88 | 440 | 16 | 200 | Test stopped after working** | | | | — |
| | 89 | 440 | 16 | 500 | 50 | 140 | 30.0 | 140 | 3 |
| | 90 | 440 | 16 | 300 | 10 | 50 | 50.0 | 130 | 3 |

Note:
*The test was stopped because a liquid phase had been formed in the ingot during homogenizing.
**The test was stopped because defects had been formed during working.

Figure 8:
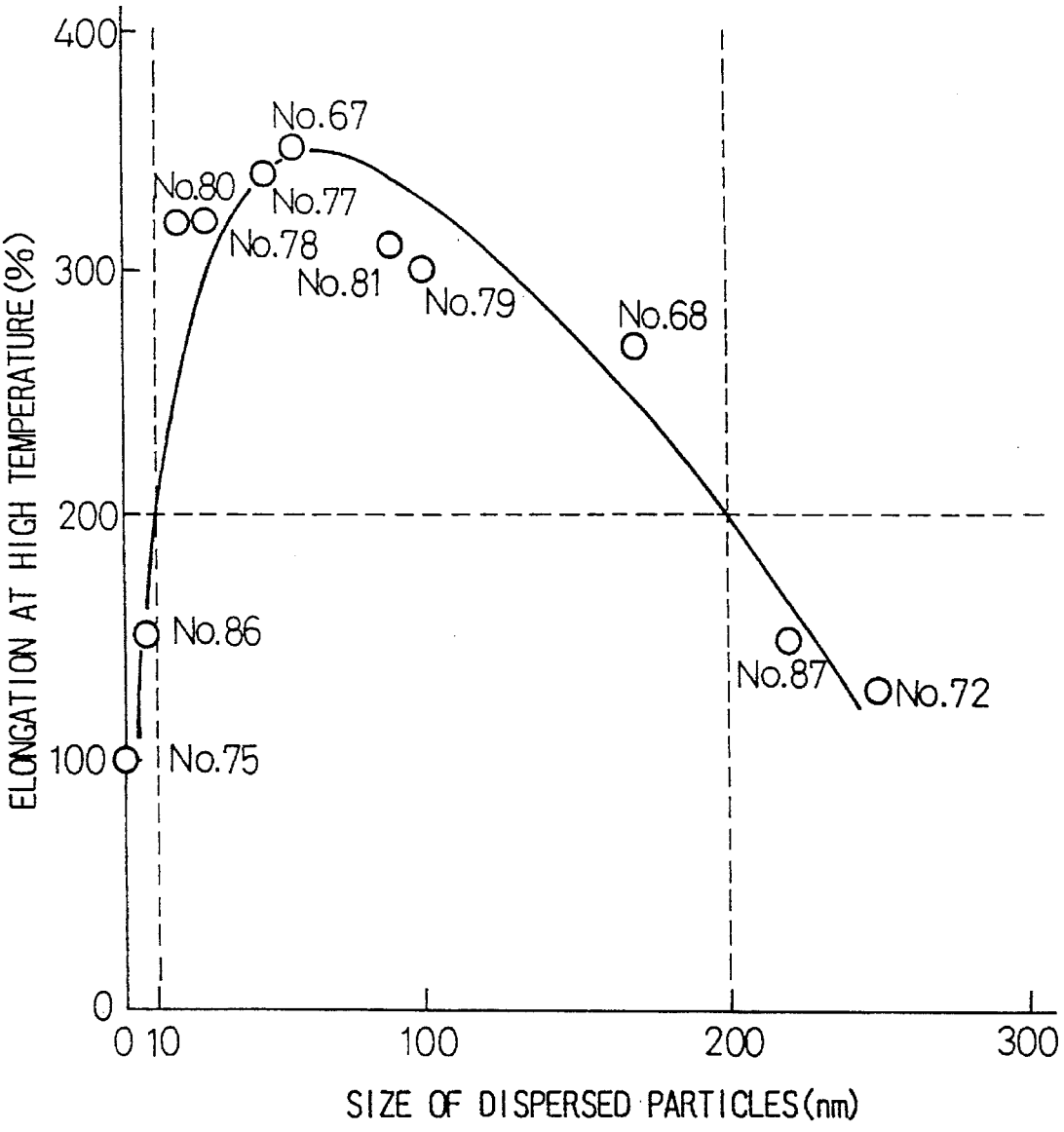
FIG. 8 is a graph showing a relationship between the size of dispersed particles and the elongation at high temperature according to Example 4.
Figure 9:
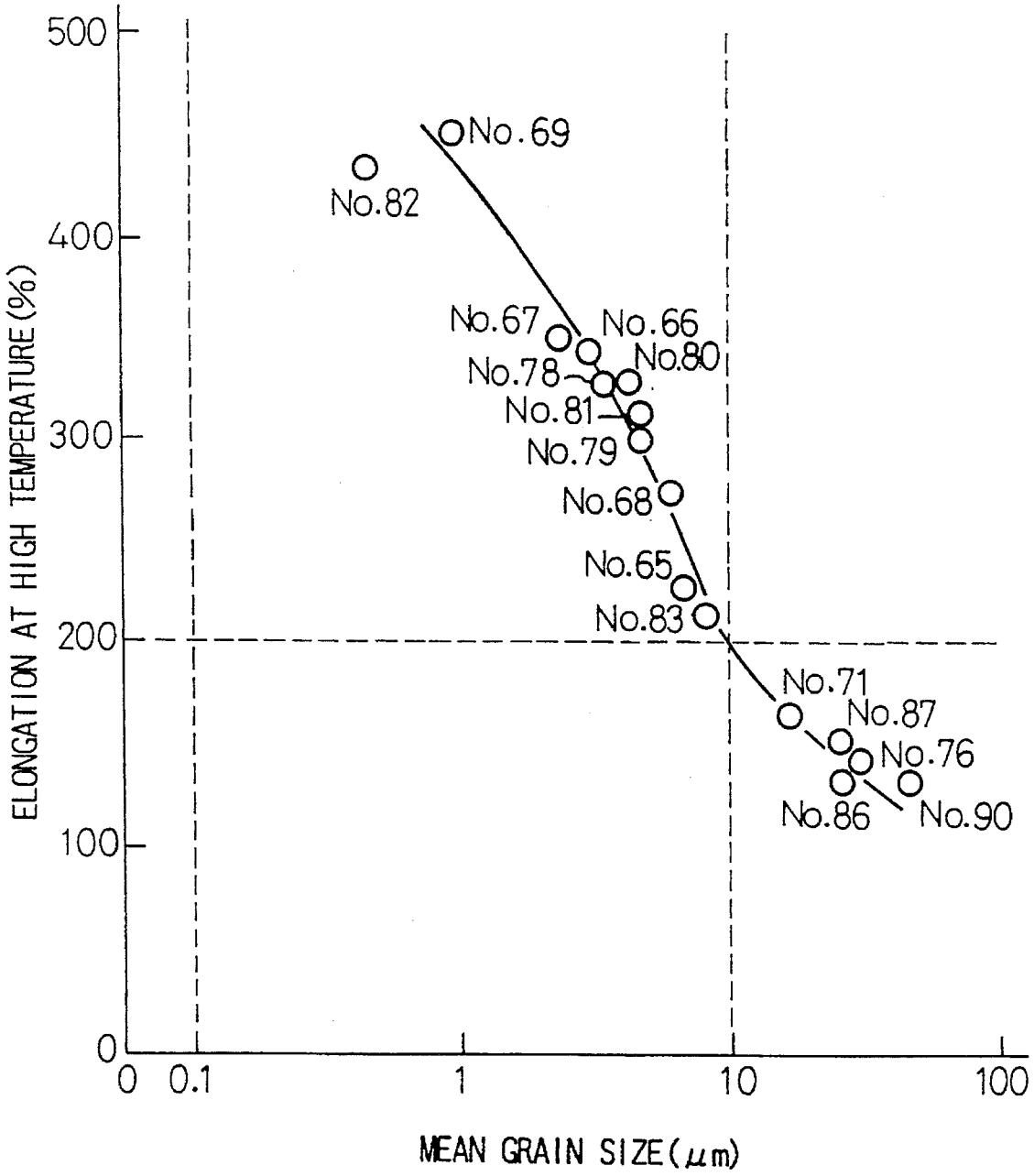
FIG. 9 is a graph showing a relationship between the mean grain size and the elongation at high temperature mean to Example 4.
Figure 10:
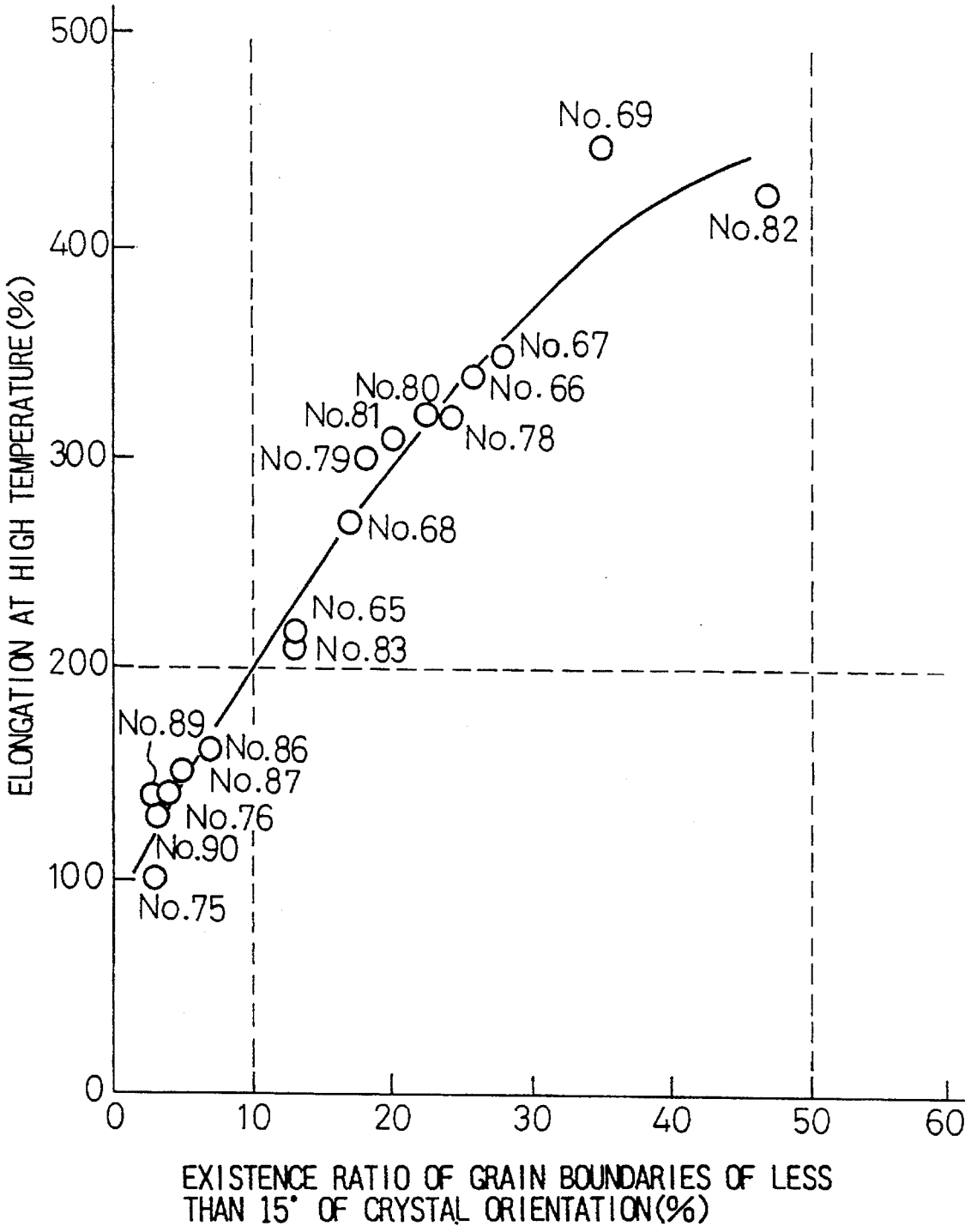
FIG. 10 is a graph showing a relationship between the proportion of grain boundaries having a misorientation of less than 15° and the elongation at high temperature according to Example 4.
Figure 11:
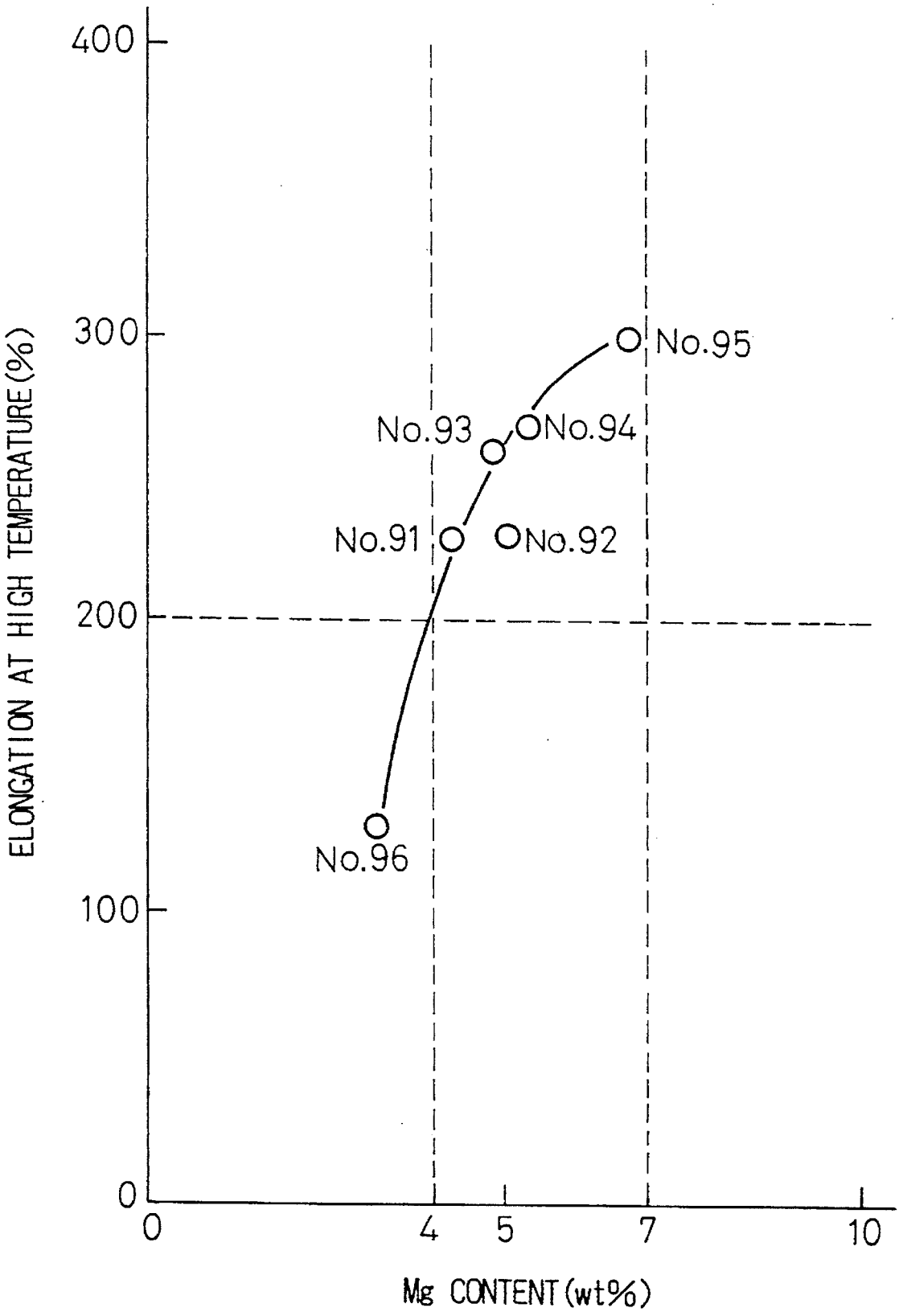
FIG. 11 is a graph showing a relationship between the content of Mg and the elongation at high temperature according to Example 5.

The superplastic products thus obtained were tested in the same manner as described above. The results thus obtained are shown in FIGS. 8 to 10. Samples No. 77 to 83 exhibited a superplastic elongation of at least 200%. Since the homogenizing temperature of Sample No. 84 was high, a liquid phase was formed in the ingot. Accordingly, the subsequent test was stopped. Since the homogenizing temperature of Sample No. 85 was low, a crystallized β-phase did not dissolve sufficiently. As a result, defects were formed during hot working, and the subsequent test was stopped. Since the time for homogenizing Sample No. 86 was short, the dispersed particles exhibited only a small amount of growth,

Example 5

Aluminum alloys having compositions according to the 7th and the 16th invention as shown in Table 9 were melted and cast. The ingots thus obtained were homogenized at 440° C. for 16 hours.

TABLE 9

| | Sample No. | Mg | Sc | Zr | Mm | Fe | Si | Cu | Ti | Al | Size of dispersed particles (nm) | Grain size (μm) | High temp. elongation (%) | Proportion of grain boundaries having misorientation <15° (%) |
|---|---|---|---|---|---|---|---|---|---|---|---|---|---|---|
| | | Chemical composition (wt. %) | | | | | | | | | | | | |
| Ex. | 91 | 4.3 | 0.009 | — | 0.13 | 0.08 | 0.05 | 0.01 | — | Bal. | 150 | 5.5 | 230 | 13 |
| | 92 | 5.1 | 0.011 | — | 0.21 | 0.08 | 0.05 | 0.01 | — | Bal. | 160 | 6.0 | 230 | 16 |
| | 93 | 4.9 | 0.013 | 0.20 | — | 0.08 | 0.05 | 0.01 | — | Bal. | 50 | 3.0 | 260 | 15 |
| | 94 | 5.3 | 0.08 | 0.22 | — | 0.08 | 0.05 | 0.01 | — | Bal. | 60 | 2.5 | 270 | 19 |
| | 95 | 6.8 | 0.008 | 0.19 | — | 0.08 | 0.05 | 0.01 | — | Bal. | 50 | 1.0 | 300 | 25 |
| Comp. | 96 | 3.2 | — | — | — | 0.20 | 0.40 | 0.04 | 0.12 | Bal. | 150 | 7.0 | 130 | 11 |
| Ex. | 97 | 5.1 | — | 0.19 | — | 0.08 | 0.05 | 0.01 | — | Bal. | 50 | 15 | 170 | 16 |
| | 98 | 4.1 | 0.13 | — | 0.11 | 0.08 | 0.05 | 0.01 | — | Bal. | 240 | 40 | 120 | 12 |
| | 99 | 4.7 | 0.010 | 1.3 | — | 0.08 | 0.05 | 0.01 | — | Bal. | Test after working stopped* | | | — |
| | 100 | 7.2 | 0.009 | 0.18 | — | 0.08 | 0.05 | 0.01 | — | Bal. | Test after working stopped** | | | — |

TABLE 9-continued

| Sample | Chemical composition (wt. %) | | | | | | | | | Size of dispersed particles | Grain size | High temp. elongation | Proportion of grain boundaries having misorientation |
|---|---|---|---|---|---|---|---|---|---|---|---|---|---|
| No. | Mg | Sc | Zr | Mm | Fe | Si | Cu | Ti | Al | (nm) | (μm) | (%) | <15° (%) |
| 101 | 5.2 | — | — | — | 0.08 | 0.05 | 0.01 | — | Bal. | — | 140 | 100 | 2 |
| 102 | 5.4 | 0.011 | — | — | 0.08 | 0.05 | 0.01 | — | Bal. | 40 | 35 | 120 | 4 |

Note:
*The test was stopped because defects had formed during working.
**The test was stopped because cracks had formed during working.

The ingots thus homogenized were hot swaged at 200° C. to have a working ratio of 50%, and water cooled to obtain ingot-made superplastic aluminum alloy products.

Test pieces each having a parallel portion 5 mm in diameter and 15 mm in length were taken from the superplastic products, and subjected to high temperature tensile test at a temperature from 300° to 500° C. at a strain rate from $5.5\times10^{-4}$ to $1.1\times10^{-1}$/sec.

The results thus obtained are shown in FIGS. 11 to 14. Samples No. 91 to 95 exhibited a superplastic elongation of at least 200%. Since Sample No. 96 contained an insufficient amount of Mg, the sample was not sufficiently solution strengthened. Accordingly, the sample did not exhibit superplasticity. Since Sample No. 97 contained no Sc, grain growth took place during homogenizing treatment, and a fine grain structure was not formed by subsequent hot working. Accordingly, the sample did not exhibit superplasticity. Since coarse intermetallic compounds of Sc were crystallized in Sample No. 98, the inhibition of grain growth during high temperature deformation became difficult. As a result, the grain structures were coarsened, and the sample did not exhibit superplasticity. Since coarse intermetallic compounds were crystallized in Sample No. 99, defects were formed during hot working. Accordingly, the subsequent test was stopped. Since Sample No. 100 contained a large amount of Mg, cracks were formed during hot working. Accordingly, the subsequent test was stopped. Since Sample No. 101 contained no fine spheroidal dispersed particles, grain growth took place during high temperature deformation. Accordingly, the sample did not exhibit superplasticity. Since Sample No. 102 did not contain a sufficient amount of fine spheroidal dispersed particles, grain growth took place during high temperature deformation. Accordingly, the sample did not exhibit superplasticity.

An aluminum alloy having the composition shown in Sample No. 92 was subjected to ingot-making in the same manner as described above, and worked and heat treated under the conditions shown in Table 10.

TABLE 10

| | Sample No. | Homogenizing Temp. (°C.) | Homogenizing Time (hr) | Hot working Temp. (°C.) | Hot working Working ratio (%) | Size of dispersed particles (nm) | Grain size (μm) | High temp. elong. (%) | Proportion of grain boundaries having misorientation <15° (%) |
|---|---|---|---|---|---|---|---|---|---|
| Ex. | 103 | 440 | 16 | 200 | 50 | 160 | 6.0 | 230 | 16 |
| | 104 | 400 | 16 | 200 | 50 | 130 | 5.0 | 240 | 14 |
| | 105 | 500 | 16 | 200 | 50 | 180 | 8.0 | 210 | 13 |
| | 106 | 440 | 10 | 200 | 50 | 110 | 4.0 | 260 | 14 |
| | 107 | 440 | 20 | 200 | 50 | 170 | 7.0 | 220 | 12 |
| | 108 | 440 | 16 | 200 | 90 | 150 | 0.3 | 330 | 43 |
| | 109 | 440 | 16 | 25 | 50 | 160 | 0.5 | 320 | 48 |
| Comp. Ex. | 110 | 550 | Test stopped after homogenizing* | | | | | | — |
| | 111 | 300 | 16 | 200 | Test stopped after working** | | | | — |
| | 112 | 440 | 5 | 200 | 50 | 8 | 20 | 160 | 7 |
| | 113 | 440 | 30 | 200 | 50 | 270 | 60 | 110 | 3 |
| | 114 | 440 | 16 | 350 | 50 | 140 | 25 | 140 | 5 |
| | 115 | 440 | 16 | 200 | 30 | 50 | 50 | 110 | 3 |

Figure 12:
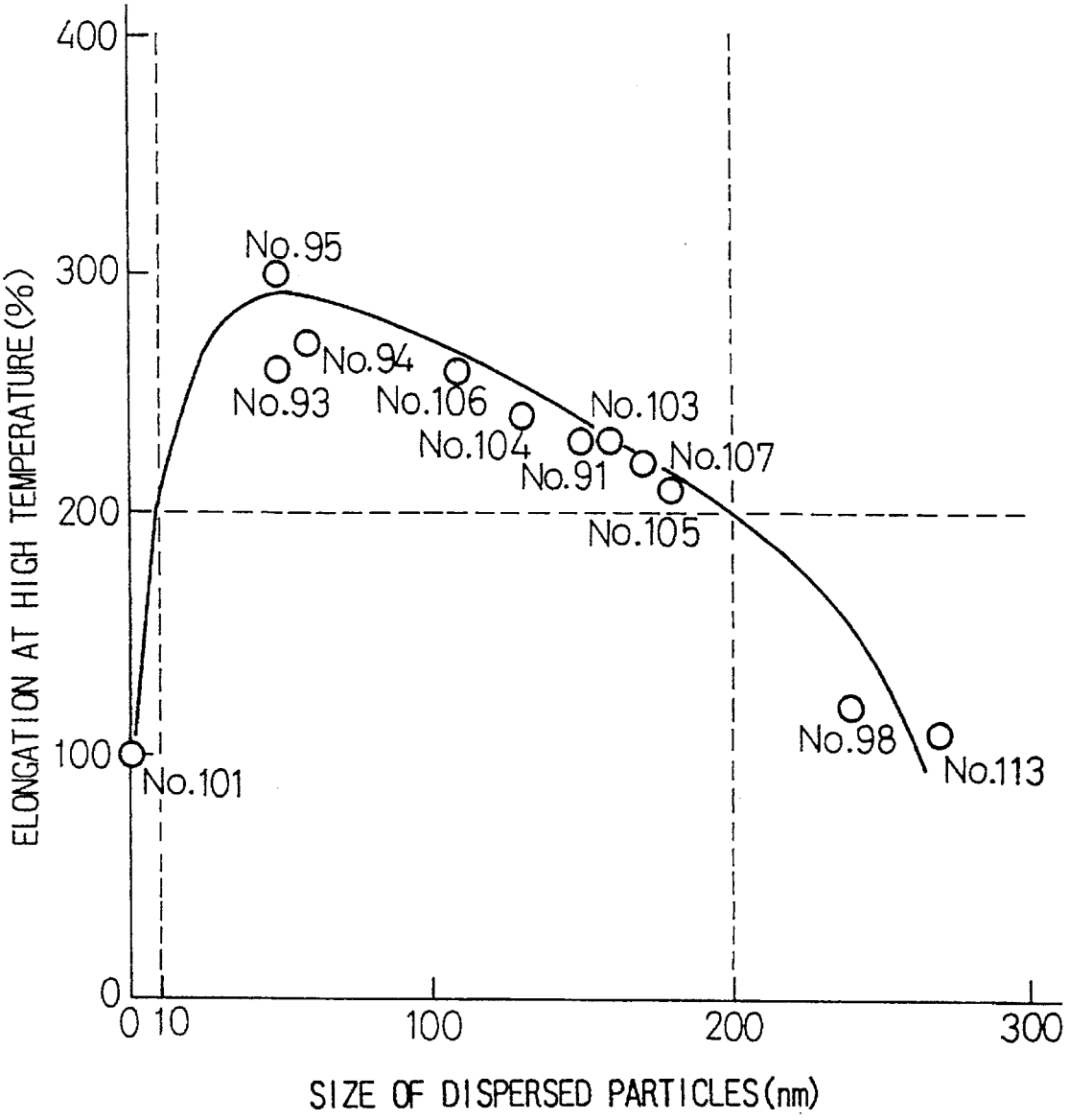
FIG. 12 is a graph showing a relationship between the size of dispersed particles and the elongation at high temperature according to Example 5.
Figure 13:
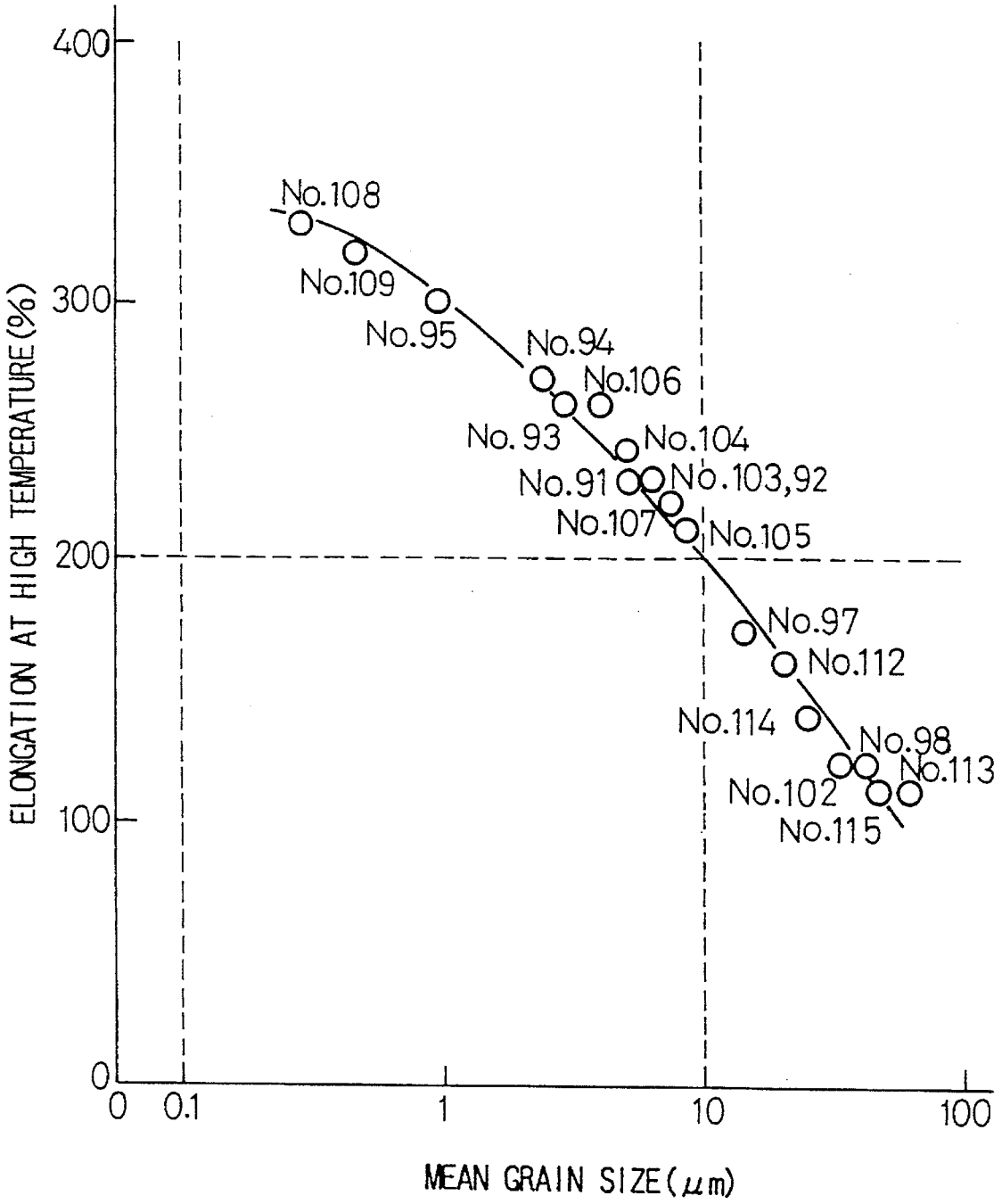
FIG. 13 is a graph showing a relationship between the mean grain size and the elongation at high temperature according to Example 5.
Figure 14:
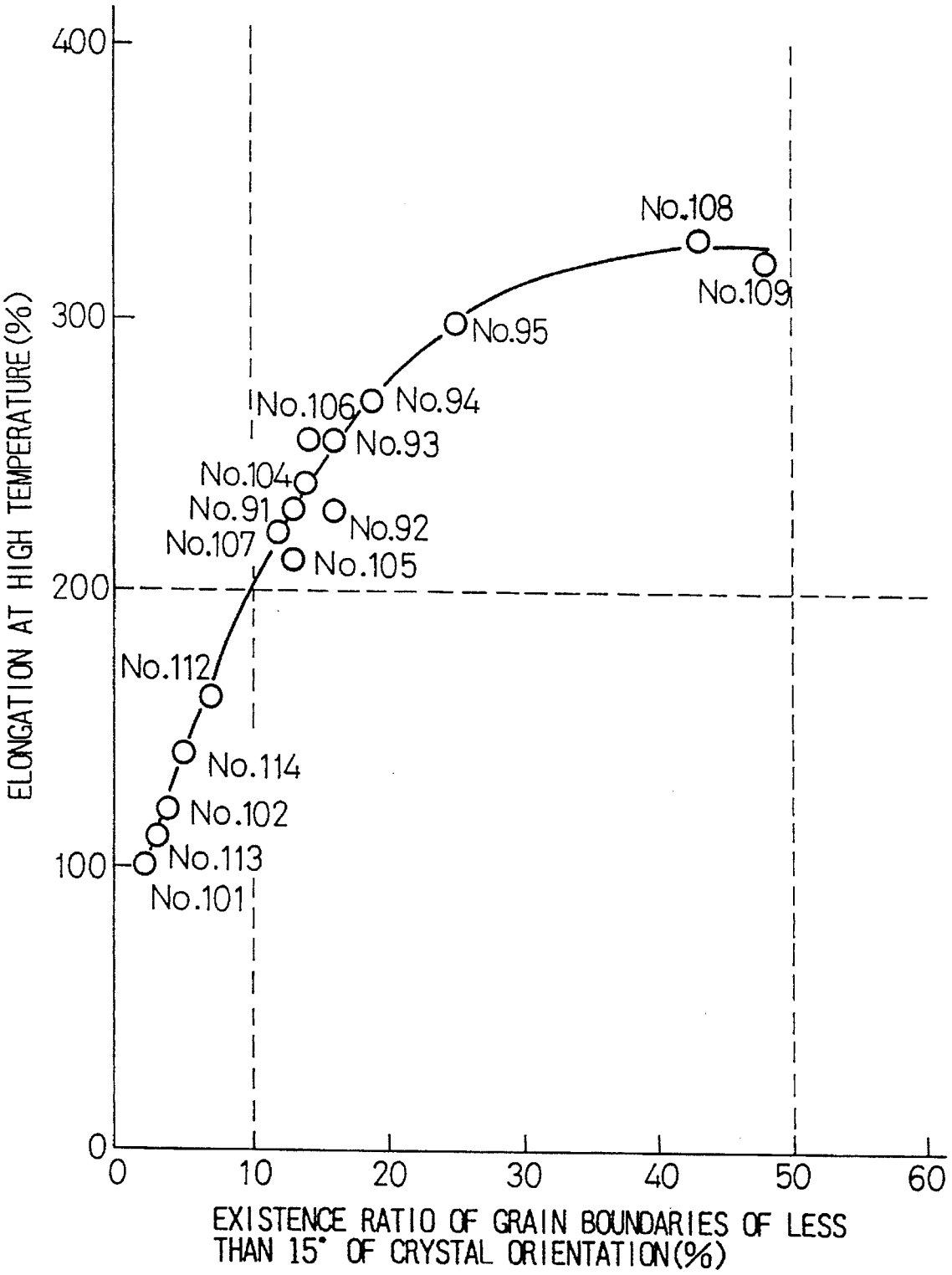
FIG. 14 is a graph showing a relationship between the proportion of grain boundaries having a misorientation of less than 15° and the elongation at high temperature according to Example 5.

The superplastic products thus obtained were tested in the same manner as described above. The results thus obtained are shown in FIGS. 12 to 14. Samples No. 103 to 109 exhibited a superplastic elongation of at least 200%. Since the homogenizing temperature of Sample No. 110 was high, a liquid phase was formed in the ingot. Accordingly, the subsequent test was stopped. Since the homogenizing temperature of Sample No. 111 was low, a crystallized β-phase did not dissolve sufficiently, and defects were formed during hot working. Accordingly, the subsequent test was stopped. Since the time for homogenizing Sample No. 112 was short, sufficient dispersed particles could not be obtained. As a result, the inhibition of grain growth during high temperature deformation became difficult, and the grain structures were coarsened. Accordingly, the sample did not exhibit superplastic deformation. Since the homogenizing time of Sample No. 113 was long, the dispersed particles were coarsened. As a result, the inhibition of grain growth during high temperature deformation became difficult, and the grain structures were coarsened. As a result, the sample did not exhibit superplasticity. Since the hot working temperature of Sample No. 114 was high, the grain structure was coarsened. Accordingly, the sample did not exhibit superplasticity.

Since the working ratio of the hot working of Sample No. 115 was low, the grain structure became coarse. Accordingly, the sample did not exhibit superplasticity.

Example 6

Aluminum alloys having compositions according to the 9th and the 17th invention as shown in Table 11 were melted and cast. The resultant ingots were homogenized at 440° C. for 24 hours.

Furthermore, aluminum alloys having compositions according to the 11th and the 17th invention as shown in Table 12 were melted and cast. The resultant ingots were homogenized at 440° C. for 24 hours.

TABLE 11

| | Sample | Chemical composition (wt. %) | | | | | | | | Size of diepersed | Grain size | High temp. elon- | 0.2% Proof stress before baking | 0.2% Proof stress after baking |
|---|---|---|---|---|---|---|---|---|---|---|---|---|---|---|
| | No. | Mg | Cu | Li | Zr | Mm | Fe | Si | Al | particles (nm) | (μm) | gation (%) | (kgf/mm²) | (kgf/mm²) |
| Ex. | 116 | 9.38 | 0.80 | — | 0.12 | — | 0.08 | 0.05 | Bal. | 45 | 3.0 | 280 | 19.4 | 25.1 |
| | 117 | 9.40 | 0.21 | — | 0.11 | — | 0.08 | 0.05 | Bal. | 44 | 3.0 | 280 | 19.5 | 25.1 |
| | 118 | 9.39 | 1.93 | — | 0.11 | — | 0.08 | 0.05 | Bal. | 47 | 3.5 | 270 | 19.7 | 23.9 |
| | 119 | 9.43 | — | 0.87 | 0.13 | — | 0.08 | 0.05 | Bal. | 41 | 2.5 | 290 | 19.7 | 25.6 |
| | 120 | 7.11 | 0.84 | — | 0.12 | — | 0.08 | 0.05 | Bal. | 46 | 6.0 | 220 | 18.7 | 23.6 |
| | 121 | 14.3 | 0.88 | — | 0.12 | — | 0.08 | 0.05 | Bal. | 43 | 2.0 | 310 | 20.1 | 25.4 |
| | 122 | 9.33 | 0.82 | — | 0.34 | — | 0.08 | 0.05 | Bal. | 54 | 5.0 | 240 | 19.6 | 25.1 |
| | 123 | 9.48 | 0.91 | — | — | 0.28 | 0.08 | 0.05 | Bal. | 170 | 8.0 | 210 | 19.7 | 25.2 |
| Comp. | 124 | 9.44 | 2.54 | — | 0.13 | — | 0.08 | 0.05 | Bal. | 240 | 17 | 170 | 19.8 | 23.1 |
| Ex. | 125 | 6.31 | — | — | 0.11 | — | 0.08 | 0.05 | Bal. | 45 | 12 | 180 | 17.2 | 17.0 |
| | 126 | 15.8 | 0.87 | — | 0.11 | — | 0.08 | 0.05 | Bal. | | Test after working stopped* | | | |
| | 127 | 9.46 | 0.85 | — | — | — | 0.08 | 0.05 | Bal. | — | 150 | 100 | 19.6 | 25.0 |
| | 128 | 9.52 | 0.93 | — | 1.31 | — | 0.08 | 0.05 | Bal. | | Test after working stopped* | | | |

Note:
Baking condition: The test piece was stretched to have a stretch amount of 5%, and heated at 180° C. for 30 minutes.
*The test was stopped because cracks had formed during working.

The ingots thus homogenized were then hot swaged at 400° C. to have a working ratio of 10%, precipitation treated at 400° C. for 1 hour, hot swaged at 200° C. to have a working ratio of 40%, and water cooled to obtain ingot-made superplastic aluminum alloy products.

Test pieces each having a parallel portion 5 mm in diameter and 15 mm in length were taken from the superplastic products, and subjected to high temperature tensile test at a temperature from 300° to 500° C. at a strain rate from $5\times10^{-1}$ to $1.1\times10^{-1}$/sec. To investigate the baking hardenability, the annealed products of the superplastic products were worked to have a working ratio of 5%, heat treated at 180° C. for 30 minutes, and tensile tested at room temperature.

Samples No. 116 to No. 123 which were examples exhibited a superplastic elongation of at least 200% and excellent baking hardenability. Sample No. 124 which was a comparative example contained a large amount of Cu, and formed acicular intermetallic compounds which hindered boundary sliding. Accordingly, the sample did not show superplasticity. Since Sample No. 125 contained an insufficient amount of Mg, the sample exhibited neither sufficient solution strengthening nor superplasticity. Moreover, since the sample contained no Cu, the sample did not exhibit baking hardenability. Since Sample No. 126 contained a large amount of Mg, cracks were formed during the first hot working. Accordingly, the subsequent test was stopped. Since Sample No. 127 contained no fine spheroidal dispersed particles, the grain structures were coarsened during high temperature deformation. Accordingly, the sample did not exhibit superplasticity. Since coarse intermetallic compounds were crystallized in Sample No. 128, cracks were formed during the first hot working. Accordingly, the subsequent test was stopped.

TABLE 12

| | Sample No. | Chemical composition (wt. %) Mg | Cu | Zr | In | Sn | Fe | Si | Al |
|---|---|---|---|---|---|---|---|---|---|
| Ex. | 129 | 9.38 | 0.81 | 0.12 | 0.12 | — | 0.08 | 0.05 | Bal. |
| | 130 | 9.44 | 0.83 | 0.11 | 0.03 | — | 0.08 | 0.05 | Bal. |
| | 131 | 9.48 | 0.78 | 0.11 | 0.19 | — | 0.08 | 0.05 | Bal. |
| | 132 | 9.39 | 0.85 | 0.13 | — | 0.12 | 0.08 | 0.05 | Bal. |
| Comp. Ex. | 133 | 9.61 | 0.74 | 0.12 | — | — | 0.08 | 0.05 | Bal. |
| | 134 | 9.70 | 0.88 | 0.13 | 0.33 | — | 0.08 | 0.05 | Bal. |

| | Sample No. | Size of dispersed particles (nm) | Grain Size (μm) | High temp. elongation (%) | 0.2% Proof stress Hardness (Hv) before baking (kgf/mm²) | after baking (kgf/mm²) | before aging at room temp. | after aging at room temp. 500 hr |
|---|---|---|---|---|---|---|---|---|
| Ex. | 129 | 46 | 3.5 | 260 | 19.3 | 25.6 | 121 | 128 |
| | 130 | 44 | 3.0 | 270 | 19.4 | 24.8 | 123 | 132 |
| | 131 | 51 | 4.5 | 240 | 19.3 | 26.0 | 122 | 125 |
| | 132 | 48 | 4.0 | 260 | 19.2 | 25.1 | 120 | 129 |
| Comp. Ex. | 133 | 47 | 4.0 | 270 | 19.4 | 24.6 | 124 | 140 |
| | 134 | Test after working and heat treatment stopped* | | | | | | |

Note:
Baking condition: The test piece was stretched to have a stretch amount of 5%, and heated at 180° C. for 30 minutes.
*The test was stopped because defects were formed.

The ingots thus homogenized were hot swaged at 400° C. to have a working ratio of 10%, precipitation treated at 400° C. for 1 hour, hot swaged at 200° C. to have a working ratio of 40%, and water cooled to obtain ingot-made superplastic aluminum alloy products. The superplastic products thus obtained were tested in the same manner as described above.

Samples No. 129 to No. 132 which were examples exhibited a superplastic elongation of at feast 200%, improved baking hardenability due to the addition of In, etc., and inhibited secular change. Since Sample No. 133 contained no added In, etc., the sample exhibited marked secular change. Since coarse intermetallic compounds having a low melting point were formed in Sample No. 134, defects were formed during working and heat treatment. Accordingly, the subsequent test was stopped.

An aluminum alloy having the composition shown in Sample No. 117 was subjected to ingot-making in the same manner as described above, and worked and heat treated under the conditions shown in Table 13.

TABLE 13

| Ex. | Sample No. | Homog. temp. (°C.) | 1st Hot working Temp. (°C.) | Working ratio (%) | Precip. temp. (°C.) | 2nd Hot working Temp. (°C.) | Working ratio (%) | Cooling method |
|---|---|---|---|---|---|---|---|---|
| Ex. | 135 | 440 | 400 | 10 | 400 | 300 | 40 | Water |
| | 136 | 400 | 400 | 10 | 400 | 300 | 40 | Water |
| | 137 | 500 | 400 | 10 | 400 | 300 | 40 | Water |
| | 138 | 440 | 500 | 10 | 400 | 300 | 40 | Water |
| | 139 | 440 | 400 | 40 | 400 | 300 | 40 | Water |
| | 140 | 440 | 400 | 10 | 500 | 300 | 40 | Water |
| | 141 | 440 | 400 | 10 | 400 | 300 | 90 | Water |
| | 142 | 440 | 400 | 10 | 400 | 400 | 40 | Water |
| Comp. Ex. | 143 | 300 | 400 | 10 | 400 | 300 | 40 | Water |
| | 144 | 550 | 400 | 10 | 400 | 300 | 40 | Water |
| | 145 | 440 | 300 | 10 | 400 | 300 | 40 | Water |
| | 146 | 440 | 550 | 10 | 400 | 300 | 40 | Water |
| | 147 | 440 | 400 | 10 | 300 | 300 | 40 | Water |
| | 148 | 440 | 400 | 10 | 550 | 300 | 40 | Water |
| | 149 | 440 | 400 | 10 | 400 | 200 | 40 | Water |
| | 150 | 440 | 400 | 10 | 400 | 500 | 40 | Water |
| | 151 | 440 | 400 | 10 | 400 | 300 | 20 | Water |
| | 152 | 440 | 400 | 10 | 400 | 300 | 40 | Slow |

| | Sample No. | Size of dispersed particles (nm) | Grain size (mm) | High temp. elongation (%) | 0.2% Proof stress before baking (kgf/mm²) | after baking (kgf/mm²) |
|---|---|---|---|---|---|---|
| Ex. | 135 | 45 | 3.0 | 280 | 19.4 | 25.1 |
| | 136 | 39 | 4.5 | 260 | 19.6 | 25.3 |
| | 137 | 84 | 7.0 | 220 | 19.4 | 25.2 |

TABLE 13-continued

| | | | | | | |
|---|---|---|---|---|---|---|
| | 138 | 51 | 5.5 | 230 | 19.5 | 25.2 |
| | 139 | 44 | 2.5 | 280 | 19.5 | 25.0 |
| | 140 | 56 | 6.0 | 220 | 19.4 | 25.1 |
| | 141 | 47 | 0.9 | 350 | 19.7 | 24.9 |
| | 142 | 79 | 9.0 | 210 | 19.3 | 25.1 |
| Comp. | 143 | Test stopped because of crack formation during working | | | | |
| Ex. | 144 | Test stopped because of liquid phase formation during working | | | | |
| | 145 | 39 | 26 | 150 | 19.7 | 24.8 |
| | 146 | Test stopped because of defect formation during working | | | | |
| | 147 | 42 | 34 | 140 | 19.5 | 24.7 |
| | 148 | Test stopped because of liquid phase formation during working | | | | |
| | 149 | Test stopped because of crack formation during working | | | | |
| | 150 | 110 | 120 | 90 | 19.3 | 25.1 |
| | 151 | 43 | 78 | 100 | 19.4 | 25.0 |
| | 152 | 1300 | 51 | 110 | 18.9 | 19.5 |

Note:
Water = Water cooling, Slow = Slow cooling
Homog. temp. = Homogenizing temperature
Precip. = Precipitation
Note:
Baking condition: The test piece was stretched to have a stretch amount of 5% and baked at 180° C. for 30 minutes.

The superplastic products thus obtained were tested in the same manner as described above.

Samples No. 135 to No. 142 exhibited a superplastic elongation of at least 200% and excellent baking hardenability. Since the homogenizing temperature of Sample No. 143 was low, a crystallized Al—Mg intermetallic compound did not sufficiently dissolve, and cracks formed during the first hot working. Accordingly, the subsequent test was stopped. Since the homogenizing temperature of Sample No. 144 was high, a liquid phase was formed. Accordingly, the subsequent test was stopped. The temperature of the first hot working of Sample No. 145 was low, sufficient spheroidal dispersed particles were not obtained. As a result, grain coarsening took place during high temperature deformation. Accordingly, the sample did not exhibit superplasticity.

Since the temperature of the first hot working of Sample No. 146 was high, defects were formed during working. Accordingly, the subsequent test was stopped. Since the precipitation temperature of Sample No. 147 was low, sufficient spheroidal dispersed particles could not be obtained. As a result, grain coarsening took place during high temperature deformation. Accordingly, the sample did not exhibit superplasticity. Since the precipitation temperature of Sample No. 148 was high, a liquid phase was formed. Accordingly, the subsequent test was stopped. Since the temperature of the second hot working of Sample No. 149 was low, cracks were formed during hot working. Accordingly, the subsequent test was stopped. Since the temperature of the second hot working of Sample No. 150 was high, the grain structure was coarsened. Accordingly, the sample did not exhibit superplasticity. Since the working ratio of the second working of Sample No. 151 was low, the recrystallization structure was coarsened. Accordingly, the sample did not exhibit superplasticity. Since the cooling rate of Sample No. 152 was low, a Cu-system intermetallic compound was formed. Accordingly, the sample did not exhibit baking hardenability.

Furthermore, an aluminum alloy having the composition shown in Sample No. 117 was worked and heat treated in the same manner as described above to obtain a superplastic product. The superplastic product thus obtained was subjected to superplastic working under the conditions as shown in Table 14 to have an elongation of 100%. To investigate the baking hardenability, the superplastically worked bodies were worked to have a working ratio of 5%, heat treated at 180° C. for 30 minutes, and tensile tested at room temperature.

TABLE 14

| | | Superplastic working | | 0.2% Proof stress (kgf/mm$^2$) | |
|---|---|---|---|---|---|
| | Sample No. | temp. (°C.) | Cooling rate | before baking | after baking |
| Ex. | 153 | 400 | Water cooling | 19.4 | 24.5 |
| | 154 | 400 | Forced a.c. | 19.2 | 23.7 |
| Comp. | 155 | 300 | Test stopped* | | |
| Ex. | 156 | 400 | Natural a.c. | 18.7 | 19.2 |

Note:
Baking condition: The test piece was stretched to have a stretch amount of 5% and heated at 180° C. for 30 minutes.
a.c. = air-cooling
*The test was stopped because the test piece was incapable of being superplastically worked.

Samples No. 153 and No. 154 exhibited baking hardenability. Since the temperature of the superplastic working of Sample No. 155 was low, superplasticity was not developed. Since the cooling rate of Sample No. 156 was low, a Cu-system intermetallic compound was formed. Accordingly, the sample did not exhibit baking hardenability.

Example 7

Aluminum alloys having compositions according to the 10th and the 18th invention shown in Table 15 were melted and cast. The resultant ingots were homogenized at 440° C. for 24 hours.

TABLE 15

| | Sample No. | Chemical composition (wt. %) Mg | Cu | Li | Zr | Mm | Fe | Si | Ti | Al | Size of dispersed particles (nm) | Grain size (μm) | High temp. elongation (%) | 0.2% Proof stress before baking (kgf/mm²) | after baking (kgf/mm²) |
|---|---|---|---|---|---|---|---|---|---|---|---|---|---|---|---|
| Ex. | 157 | 4.91 | 0.23 | — | 0.22 | — | 0.08 | 0.05 | — | Bal. | 43 | 3.5 | 240 | 17.5 | 23.2 |
| | 158 | 4.90 | 0.81 | — | 0.20 | — | 0.08 | 0.05 | — | Bal. | 45 | 3.5 | 240 | 18.2 | 23.3 |
| | 159 | 5.03 | 1.91 | — | 0.19 | — | 0.08 | 0.05 | — | Bal. | 41 | 3.0 | 240 | 18.5 | 22.6 |
| | 160 | 4.93 | — | 0.89 | 0.18 | — | 0.08 | 0.05 | — | Bal. | 38 | 2.5 | 250 | 18.4 | 24.0 |
| | 161 | 4.13 | 0.88 | — | 0.18 | — | 0.08 | 0.05 | — | Bal. | 47 | 5.0 | 220 | 17.3 | 22.2 |
| | 162 | 6.87 | 0.91 | — | 0.21 | — | 0.08 | 0.05 | — | Bal. | 44 | 2.0 | 260 | 19.1 | 24.8 |
| | 163 | 5.11 | 0.86 | — | 0.37 | — | 0.08 | 0.05 | — | Bal. | 53 | 4.0 | 230 | 18.4 | 24.0 |
| | 164 | 4.93 | 0.94 | — | — | 0.23 | 0.08 | 0.05 | — | Bal. | 160 | 8.0 | 210 | 18.3 | 23.7 |
| Comp. | 165 | 4.88 | 2.83 | — | 0.20 | — | 0.08 | 0.05 | — | Bal. | 230 | 14 | 170 | 19.0 | 23.0 |
| Ex. | 166 | 3.21 | — | — | — | — | 0.40 | 0.20 | 0.12 | Bal. | 150 | 7.0 | 140 | 12.6 | 12.3 |
| | 167 | 7.30 | 0.79 | — | 0.17 | — | 0.08 | 0.05 | — | Bal. | Test stopped because of crack formation during working | | | | |
| | 168 | 5.08 | 0.82 | — | — | — | 0.08 | 0.05 | — | Bal. | — | 160 | 90 | 18.2 | 23.5 |
| | 169 | 5.10 | 0.90 | — | 1.32 | — | 0.08 | 0.05 | — | Bal. | Test stopped because of crack formation during working | | | | |

Note:
Baking condition: The test piece was stretched to have a stretch amount of 5% and baked at 180° C. for 30 minutes.

The resultant ingots were then homogenized, hot swaged at 400° C. to have a working ratio of 10%, then precipitation treated at 400° C. for one hour, hot swaged at 200° C. to have a working ratio of 40%, and water cooled to obtain ingot-made superplastic aluminum alloy products.

Test pieces each having a parallel portion 5 mm in diameter and 15 mm in length were taken from the superplastic products, and subjected to high temperature tensile test at a temperature from 300° to 500° C. at a strain rate from $5.5\times10^{-4}$ to $1.1\times10^{-1}$/sec. Moreover, to investigate the baking hardenability, materials obtained by annealing the superplastic products were worked to have a working ratio of 5%, heat treated at 180° C. for 30 minutes, and tensile tested at room temperature.

Samples No. 157 to No. 164 exhibited a superplastic elongation of at least 200% and excellent baking hardenability. Since Sample No. 165 contained a large amount of Cu, the sample formed a acicular intermetallic compound, which hindered boundary sliding. Accordingly, the sample did not show superplasticity. Since Sample No. 166 contained an insufficient amount of Mg, the sample exhibited neither sufficient solution strengthening nor superplasticity. Moreover, since the sample contained no Cu, it did not exhibit baking hardenability. Since Sample No. 167 contained a large amount of Mg, cracks formed during the first hot working. Accordingly, the subsequent test was stopped. Since Sample No. 168 contained no fine spheroidal dispersed particles, the grain structures were coarsened during high temperature deformation. Accordingly, the sample did not exhibit superplasticity. Since coarse intermetallic compounds were crystallized in Sample No. 169, cracks were formed during the first hot working. Accordingly, the subsequent test was stopped.

Furthermore, aluminum alloys having compositions according to the 12th and the 18th invention as shown in Table 16 were melted and cast. The resultant ingots were homogenized at 440° C. for 24 hours. The ingots were homogenized, hot swaged at 400° C. to have a working ratio of 10%, and precipitation treated at 400° C. for 1 hour.

TABLE 16

| | Sample No. | Chemical composition (wt. %) Mg | Cu | Zr | In | Sn | Fe | Si | Al |
|---|---|---|---|---|---|---|---|---|---|
| Ex. | 170 | 4.90 | 0.82 | 0.20 | 0.13 | — | 0.08 | 0.05 | Bal. |
| | 171 | 4.92 | 0.80 | 0.19 | 0.04 | — | 0.08 | 0.05 | Bal. |
| | 172 | 4.98 | 0.78 | 0.19 | 0.18 | — | 0.08 | 0.05 | Bal. |
| | 173 | 4.87 | 0.84 | 0.22 | — | 0.14 | 0.08 | 0.05 | Bal. |
| Comp. | 174 | 4.86 | 0.76 | 0.18 | — | — | 0.08 | 0.05 | Bal. |
| Ex. | 175 | 5.03 | 0.87 | 0.18 | 0.31 | — | 0.08 | 0.05 | Bal. |

| | Sample No. | Size of dispersed particles (nm) | Grain size (μm) | High temp. elongation (%) | 0.2% Proof stress Hardness (Hv) before baking (kgf/mm²) | after baking (kgf/mm²) | before aging at room temp. | after aging at room temp. 500 hr |
|---|---|---|---|---|---|---|---|---|
| Ex. | 170 | 46 | 4.0 | 230 | 18.2 | 24.4 | 105 | 112 |
| | 171 | 43 | 3.5 | 240 | 18.0 | 23.5 | 103 | 117 |
| | 172 | 53 | 5.0 | 230 | 18.1 | 24.8 | 106 | 108 |
| | 173 | 48 | 4.0 | 230 | 18.1 | 24.0 | 105 | 113 |
| Comp. | 174 | 45 | 3.5 | 230 | 17.7 | 22.9 | 104 | 128 |
| Ex. | 175 | Test after working and heat treatment stopped* | | | | | | |

Note:
Baking condition: The test piece was stretched to have a stretch amount of 5%, and heated at 180° C. for 30 minutes.
*The test was stopped because defects were formed during working and heat treatment.

The aluminum alloy products were hot swaged at 200° C. to have a working ratio of 40%, and water cooled to obtain ingot-made superplastic aluminum alloy products. The superplastic products thus obtained were tested in the same manner as described above.

Samples No. 170 to No. 173 exhibited a superplastic elongation of at least 200%, improved baking hardenability due to the addition of In, etc., and inhibited secular change. Since Sample No. 174 contained no added In, etc., the sample exhibited marked secular change. Since coarse intermetallic compounds having a low melting point were formed in Sample No. 175, defects were formed during working and heat treatment. Accordingly, the subsequent test was stopped.

An aluminum alloy having the composition shown in Sample No. 158 was subjected to ingot-making in the same manner as described above, and worked and heat treated under the conditions shown in Table 17.

TABLE 17

| | Sample No. | Homog. temp. (°C.) | 1st Hot working Temp. (°C.) | Working ratio (%) | Precip. temp. (°C.) | 2nd Hot working Temp. (°C.) | Working ratio (%) | Cooling method |
|---|---|---|---|---|---|---|---|---|
| Ex. | 176 | 400 | 400 | 10 | 400 | 200 | 40 | Water |
| | 177 | 440 | 400 | 10 | 400 | 200 | 40 | Water |
| | 178 | 550 | 400 | 10 | 400 | 200 | 40 | Water |
| | 179 | 440 | 500 | 40 | 400 | 200 | 40 | Water |
| | 180 | 440 | 400 | 10 | 400 | 200 | 40 | Water |
| | 181 | 440 | 400 | 10 | 500 | 200 | 40 | Water |
| | 182 | 440 | 400 | 10 | 400 | 200 | 90 | Water |
| Comp. | 183 | 300 | 400 | 10 | 400 | 200 | 40 | Water |
| Ex. | 184 | 580 | 400 | 10 | 400 | 200 | 40 | Water |
| | 185 | 440 | 300 | 10 | 400 | 200 | 40 | Water |
| | 186 | 440 | 580 | 10 | 400 | 200 | 40 | Water |
| | 187 | 440 | 400 | 10 | 300 | 200 | 40 | Water |
| | 188 | 440 | 400 | 10 | 580 | 200 | 40 | Water |
| | 189 | 440 | 400 | 10 | 400 | 150 | 40 | Water |
| | 190 | 440 | 400 | 10 | 400 | 300 | 40 | Water |
| | 191 | 440 | 400 | 10 | 400 | 200 | 20 | Water |
| | 192 | 440 | 400 | 10 | 400 | 200 | 40 | Slow |

| | Sample No. | Size of dispersed particles (nm) | Grain size (μm) | High temp. elongation (%) | 0.2% Proof stress before baking (kgf/mm²) | after baking (kgf/mm²) |
|---|---|---|---|---|---|---|
| Ex. | 176 | 42 | 4.0 | 230 | 18.0 | 22.9 |
| | 177 | 45 | 3.5 | 240 | 18.2 | 23.3 |
| | 178 | 93 | 6.0 | 210 | 18.5 | 23.9 |
| | 179 | 51 | 5.0 | 220 | 18.3 | 23.5 |
| | 180 | 44 | 2.5 | 250 | 18.2 | 23.3 |

TABLE 17-continued

| | | | | | | |
|---|---|---|---|---|---|---|
| | 181 | 50 | 5.5 | 210 | 18.1 | 23.4 |
| | 182 | 46 | 0.8 | 290 | 18.7 | 22.8 |
| Comp. | 183 | Test stopped because of crack formation during working | | | | |
| Ex. | 184 | Test stopped because of liquid phase formation in ingot | | | | |
| | 185 | 38 | 32 | 130 | 18.3 | 22.4 |
| | 186 | Test stopped because of crack formation during working | | | | |
| | 187 | 43 | 28 | 140 | 18.2 | 22.5 |
| | 188 | Test stopped because of liquid phase formation during heat treating | | | | |
| | 189 | 44 | 2.0 | 260 | 21.5 | 21.8 |
| | 190 | 48 | 100 | 100 | 18.1 | 23.4 |
| | 191 | 46 | 96 | 110 | 18.0 | 23.4 |
| | 192 | 1200 | 57 | 120 | 16.2 | 16.9 |

Note:
Homog. temp. = Homogenizing temperature
Precip. temp. = Precipitation temperature
Water = Water cooling, Slow = Slow cooling
Note:
Baking condition: The test piece was stretched to have a stretch amount of 5% and baked at 180° C. for 30 minutes.

The superplastic products thus obtained were tested in the same manner as described above.

Samples No. 176 to No. 182 exhibited a superplastic elongation of at least 200% and excellent baking hardenability. Since the homogenizing temperature of Sample No. 183 was low, an Al—Mg intermetallic compound did not sufficiently dissolve, and cracks were formed during the first hot working. Accordingly, the subsequent test was stopped. Since the homogenizing temperature of Sample No. 184 was high, a liquid phase was formed. Accordingly, the subsequent test was stopped. Since the temperature of the first hot working of Sample No. 185 was low, sufficient spheroidal dispersed particles were not obtained. As a result, grain coarsening took place during high temperature deformation. Accordingly, the sample did not exhibit superplasticity.

Since the temperature of the first hot working of Sample No. 186 was high, defects were formed during working. Accordingly, the subsequent test was stopped. Since the precipitation temperature of Sample No. 187 was low, sufficient spheroidal dispersed particles could not be obtained. As a result, grain coarsening took place during high temperature deformation. Accordingly, the sample did not exhibit superplasticity. Since the precipitation temperature of Sample No. 188 was high, a liquid phase was formed. Accordingly, the subsequent test was stopped. Since the temperature of the second hot working of Sample No. 189 was low, Cu was precipitated. Accordingly, the sample did not exhibit baking hardenability. Since the temperature of the second hot working Sample No. 190 was high, the grain structure was coarsened. Accordingly, the sample did not exhibit superplasticity. Since the working ratio of the second working of Sample No. 191 was low, the recrystallization structure was coarsened. Accordingly, the sample did not exhibit superplasticity. Since the cooling rate of Sample No. 192 was low, a Cu type intermetallic compound was formed. Accordingly, the sample did not exhibit baking hardenability.

Furthermore, an aluminum alloy having the composition shown in Sample No. 158 was worked and heat treated in the same manner as described above to obtain a superplastic product. The superplastic product thus obtained was subjected to superplastic working under the conditions shown in Table 18 to have an elongation of 100%. To investigate the baking hardenability, the superplastically worked bodies were worked to have a working ratio of 5%, heat treated at 180° C. for 30 minutes, and tensile tested at room temperature.

TABLE 18

| | | Superplastic working | | 0.2% Proof stress (kgf/mm$^2$) | |
|---|---|---|---|---|---|
| | Sample No. | temp. (°C.) | Cooling rate | before baking | after baking |
| Ex. | 193 | 400 | Water cooling | 18.2 | 23.1 |
| | 194 | 400 | Forced a.c. | 17.7 | 22.0 |
| Comp. | 195 | 300 | Test stopped* | | |
| Ex. | 196 | 400 | Natural a.c. | 16.1 | 17.0 |

Note:
Baking condition: The test piece was stretched to have a stretch amount of 5% and heated at 180° C. for 30 minutes.
a.c. = air cooling
*The test was stopped because the test piece had become incapable of being superplastically worked.

Samples No. 193 to No. 194 exhibited baking hardenability. Since the temperature of the superplastic working of Sample No. 195 was low, superplasticity was not developed. Since the cooling rate of Sample No. 196 was low, a Cu-system intermetallic compound was formed. Accordingly, the sample did not exhibit baking hardenability.

Example 8

Aluminum alloys having compositions according to the 19th invention as shown in Table 19 were melted and cast. The ingots thus obtained were cold swaged to have a working ratio of 10%, and precipitation treated at 400° C. for 10 hours.

TABLE 19

| | Sample No. | Chemical composition (wt. %) Mg | Zr | Mm | Fe | Si | Cu | Ti | Al | Size of dispersed particles (nm) | Grain size (μm) | High temp. elongation (%) |
|---|---|---|---|---|---|---|---|---|---|---|---|---|
| Ex. | 197 | 4.2 | — | 0.12 | 0.08 | 0.05 | 0.01 | — | Bal. | 160 | 7.0 | 220 |
| | 198 | 5.1 | — | 0.19 | 0.08 | 0.05 | 0.01 | — | Bal. | 155 | 6.5 | 220 |
| | 199 | 4.9 | 0.20 | — | 0.08 | 0.05 | 0.01 | — | Bal. | 45 | 3.5 | 240 |
| | 200 | 5.3 | 0.32 | — | 0.08 | 0.05 | 0.01 | — | Bal. | 50 | 3.0 | 240 |
| | 201 | 6.8 | 0.21 | — | 0.08 | 0.05 | 0.01 | — | Bal. | 50 | 2.0 | 250 |
| Comp. | 202 | 3.2 | — | — | 0.20 | 0.40 | 0.04 | 0.12 | Bal. | 150 | 7.0 | 130 |
| Ex. | 203 | 7.1 | 0.18 | — | 0.08 | 0.05 | 0.01 | — | Bal. | Test after working stopped* | | |
| | 204 | 5.1 | — | — | 0.08 | 0.05 | 0.01 | — | Bal. | — | 170 | 90 |
| | 205 | 4.8 | 1.4 | — | 0.08 | 0.05 | 0.01 | — | Bal. | Test after working stopped* | | |

Note:
The test was stopped because cracks had formed during working.

The precipitation treated products were then hot swaged at 200° C. to have a working ratio of 40%, and water cooled to obtain ingot-made superplastic aluminum alloy products. Test pieces each having a parallel portion 5 mm in diameter and 15 mm in length were taken from the superplastic products, and were subjected to high temperature tensile test at a temperature from 300° to 500° C. at a strain rate from $5.5\times10^{-4}$ to $1.1\times10^{-1}$/sec.

Figure 15:
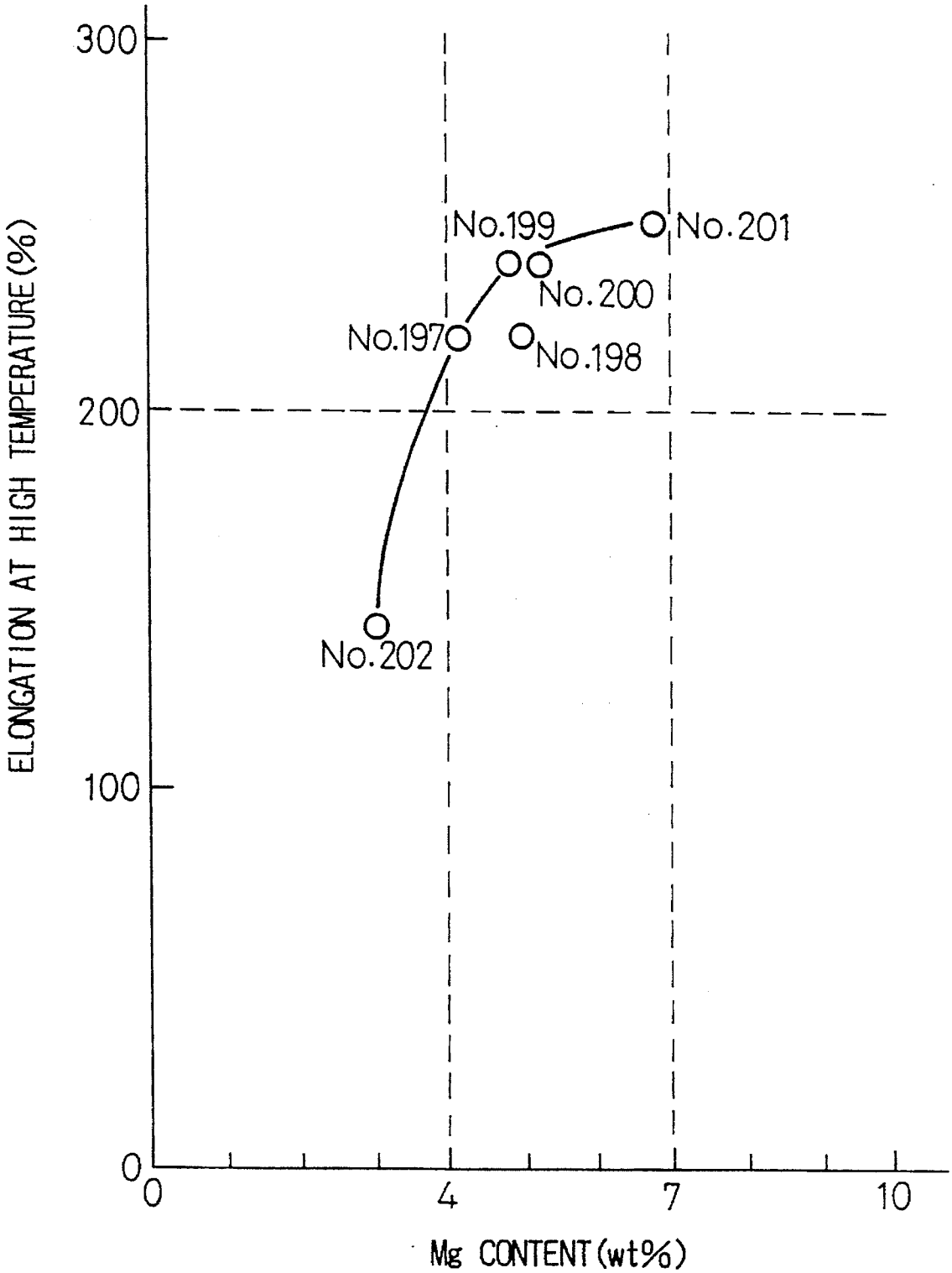
FIG. 15 is a graph showing a relationship between the content of Mg and the elongation at high temperature according Example 8.
Figure 16:
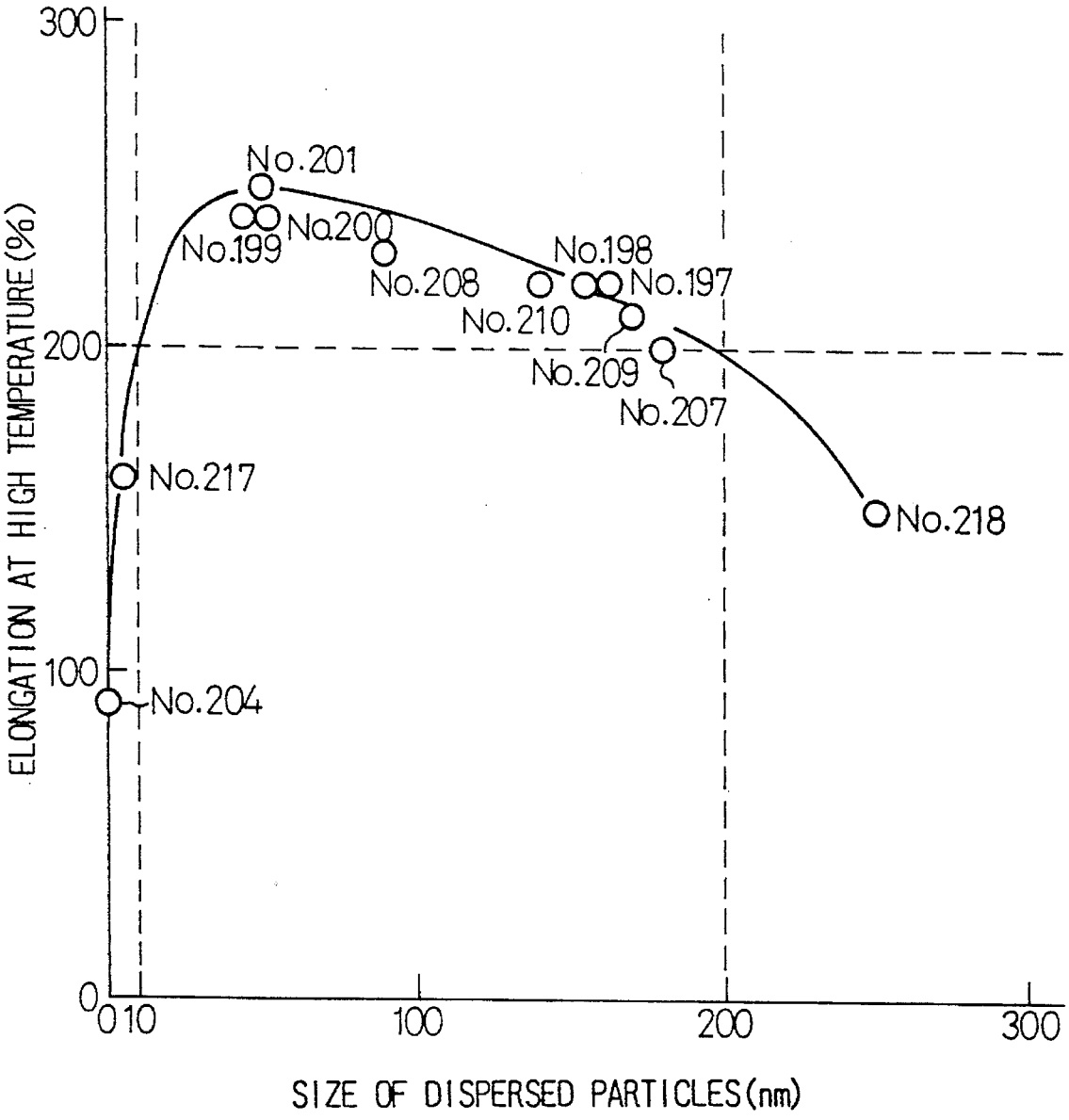
FIG. 16 is a graph showing a relationship between the size of dispersed particles and the elongation at high temperature according to Example 8.
Figure 17:
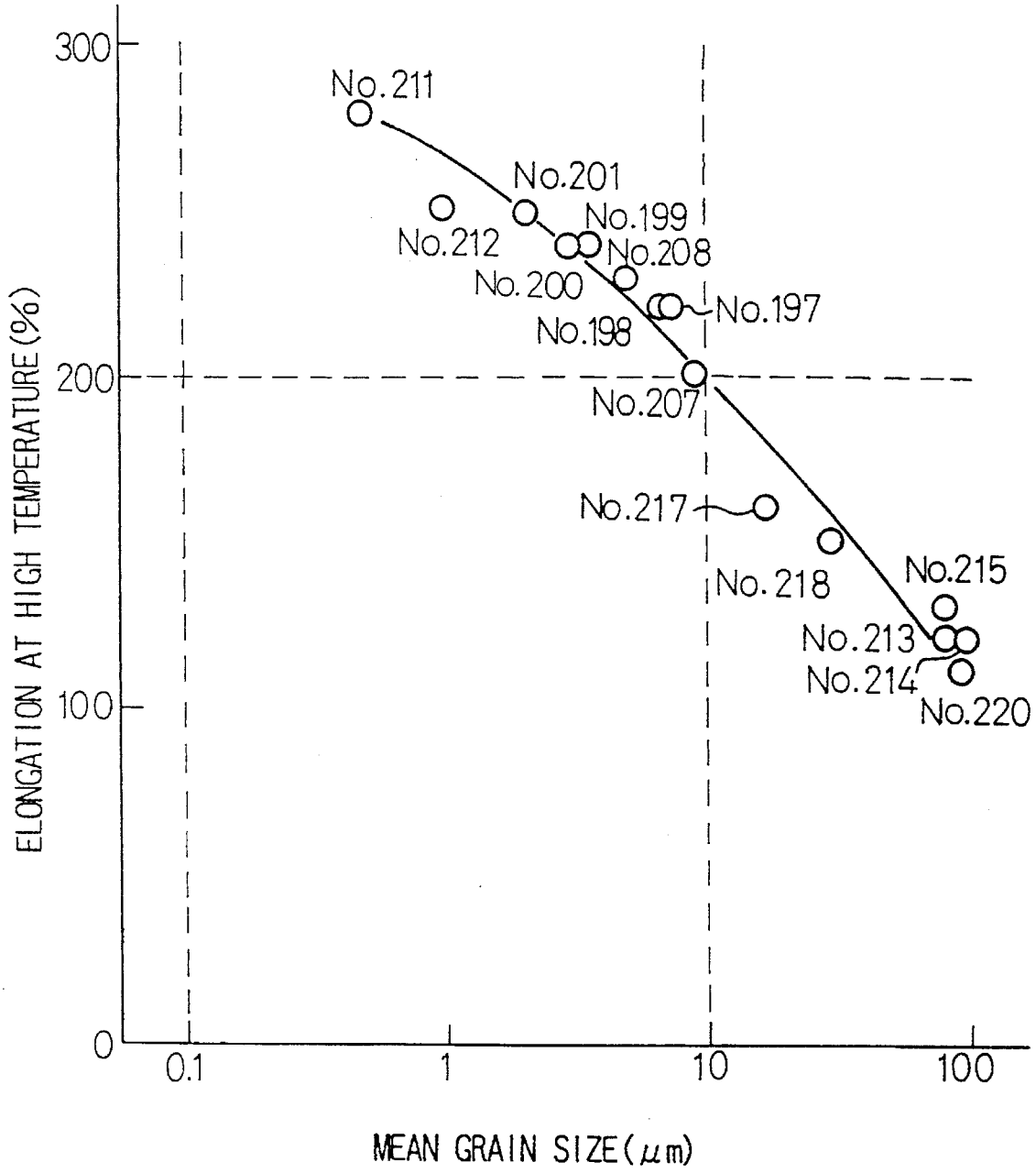
FIG. 17 is a graph showing a relationship between the mean grain size and the elongation at high temperature according to Example 8.

The results thus obtained are shown in FIGS. 15 to 17. Samples No. 197 to 201 which were examples exhibited a superplastic elongation of at least 200%. Since Sample No. 202 which was a comparative example contained an insufficient amount of Mg, the sample was not sufficiently solution strengthened. Accordingly, the sample did not exhibit superplasticity. Since Sample No. 203 contained a large amount of Mg, a large amount of Al—Mg intermetallic compound was crystallized. As a result, cracks were formed during the first working, and the subsequent test was stopped. Since Sample No. 204 contained no fine spheroidal dispersed particles, grain growth took place during high temperature deformation. As a result, the sample did not exhibit superplasticity. Since sample No. 205 crystallized coarse intermetallic compounds, cracks were formed during the first working. Accordingly, the subsequent test was stopped.

Furthermore, an aluminum alloy having the composition shown in Sample No. 198 was subjected to ingot-making in the same manner as described above, and worked and heat treated under the conditions shown in Table 20.

TABLE 20

| | Sample No. | 1st Working Temp. (°C.) | 1st Working Working ratio (%) | Precipitation treatment Temp. (°C.) | Precipitation treatment Time (hr) | 2nd Hot working Temp. (°C.) | 2nd Hot working Working ratio (%) | Size of dispersed particles (nm) | Grain size (μm) | High temp. elongation (%) |
|---|---|---|---|---|---|---|---|---|---|---|
| Ex. | 206 | 25 | 10 | 400 | 10 | 200 | 40 | 155 | 6.5 | 220 |
| | 207 | 25 | 10 | 500 | 10 | 200 | 40 | 180 | 9.0 | 200 |
| | 208 | 25 | 10 | 400 | 5 | 200 | 40 | 90 | 5.0 | 230 |
| | 209 | 25 | 10 | 400 | 15 | 200 | 40 | 170 | 8.5 | 210 |
| | 210 | 25 | 30 | 400 | 10 | 200 | 40 | 140 | 6.0 | 220 |
| | 211 | 25 | 10 | 400 | 10 | 200 | 90 | 150 | 0.5 | 280 |
| | 212 | 25 | 10 | 400 | 10 | 25 | 40 | 150 | 1.0 | 250 |
| Comp. | 213 | 400 | 10 | 400 | 10 | 200 | 40 | 130 | 90 | 120 |
| Ex. | 214 | 25 | 5 | 400 | 10 | 200 | 40 | 120 | 80 | 120 |
| | 215 | 25 | 10 | 300 | 10 | 200 | 40 | 50 | 80 | 130 |
| | 216 | 25 | 10 | 580 | | | | Test stopped* | | |
| | 217 | 25 | 10 | 400 | 2 | 200 | 40 | 5 | 15 | 160 |
| | 218 | 25 | 10 | 400 | 24 | 200 | 40 | 250 | 30 | 150 |
| | 219 | 25 | 10 | 400 | 10 | 350 | 40 | 160 | 120 | 100 |
| | 220 | 25 | 10 | 400 | 10 | 200 | 20 | 155 | 90 | 110 |

Note:
*The test was stopped because a liquid phase had formed.

The superplastic products thus obtained were tested in the same manner as described above. The results thus obtained are shown in FIGS. 16 to 17. Samples No. 206 to No. 212 which were examples exhibited a superplastic elongation of at least 200%. Since the temperature of the first working of Sample No. 213 was high, sufficient fine dispersed particles could not be obtained in the subsequent precipitation treatment. As a result, grain coarsening took place during high temperature deformation, and the sample did not exhibit superplasticity. Since the working ratio in the first working of Sample No. 214 was low, sufficient fine dispersed particles could not be obtained in the subsequent precipitation treatment. As a result, grain coarsening took place during high temperature deformation, and the sample did not exhibit superplasticity. Since the precipitation temperature of Sample No. 215 was low, sufficient fine dispersed particles could not be obtained. As a result, grain coarsening took place during high temperature deformation. Accordingly, the sample did not exhibit superplasticity. Since the precipitation temperature of Sample No. 216 was high, a liquid phase was formed. Accordingly, the subsequent test was stopped. Since the precipitation time of Sample No. 217 was short, sufficient fine dispersed particles could not be obtained. As a result, grain coarsening took place during high temperature deformation, and the sample did not exhibit superplasticity. Since the precipitation time of Sample No. 218 was long, the dispersed particles were coarsened. As a result, grain coarsening during high temperature deformation could not be inhibited, and the sample did not exhibit superplasticity. Since the temperature of the second working of Sample No. 219 was high, the grain structure was coarsened. Accordingly, the sample did not exhibit superplasticity. Since the working ratio of the second working of Sample No. 220 was low, a coarse recrystallized grain structure was formed. Accordingly, the sample did not exhibit superplasticity.

As illustrated above, although the aluminum alloy according to the present invention is an ingot-made material, the alloy is capable of developing high-speed superplasticity through dynamic recrystallization, and is excellent in strength, proof stress and baking hardenability. The quality and the productivity of machine structure parts can be improved by the use of the aluminum alloy. Moreover, the superplastic aluminum alloy according to the present invention has fine structure, and precipitation hardening and dispersion strengthening of the alloy can be realized by uniformly dispersing the fine spheroidal particles, and the improvement of corrosion resistance, weldability and toughness can be achieved. Furthermore, when the aluminum alloy of the invention is used, the following effects can be achieved: the inhibition of aging at room temperature and the improvement of secular change, the enhancement of aging at high temperature, and the improvement of stress corrosion cracking resistance and machinability.

We claim:

1. A process for producing a superplastic aluminum alloy, comprising a step of melting and casting an aluminum alloy comprising from 7 to 15% by weight of Mg, from 0.1 to 1.0% by weight of one or more one elements selected from the group consisting of misch metal (Mm), Zr, V, W, Ti, Nb, Ca, Co, Mo and Ta and the balance being Al and unavoidable impurities and homogenizing the resultant ingot at a temperature of from 300° to 530° C., a step of subjecting the product to a first hot working at a temperature of from 400° to 530° C. to give a working ratio of from 10 to 40%, a step of subsequently precipitation treating the resultant product without cooling at a temperature of from 400° to 530° C., and a step of subjecting the resultant product to a second hot working at a temperature of from 300° to 400° C. to give a working ratio of at least 40% in the second hot working alone.

2. The process of claim 1, wherein said composition comprises from 7 to 10% by weight by Mg, from 0.1 to 1.0% by weight of misch metal (Mm) and Zr in total with a Mm/Zr ratio of from 0.2 to 2.0 and the balance being Al and unavoidable impurities.

3. A process for producing a superplastic aluminum alloy, comprising a step of melting and casting an aluminum alloy comprising from 4 to less than 7% by weight of Mg, from 0.1 to 1.0% by weight of one or more one elements selected from the group consisting of misch metal (Mm), Zr, V, W, Ti, Nb, Ca, Co, Mo and Ta and the balance being Al and unavoidable impurities and homogenizing the resultant ingot at a temperature of from 230° to 560° C., a step of subjecting the product to a first hot working at a temperature of from 400° to 560° C. to give a working ratio of from 10 to 40%, a step of subsequently precipitation treating the resultant product without cooling at a temperature of from 400° to 560° C., and a step of subjecting the resultant product to a second hot working at a temperature of less than 300° C. to give a working ratio of at least 40% in the second hot working alone.

4. A process for producing a superplastic aluminum alloy, comprising a step of melting and casting an aluminum alloy comprising from 4 to less than 7% by weight of Mg, from 0.1 to 1.0% by weight of one or more elements selected from the group consisting of misch metal (Mm), Zr, V, W, Ti, Ni Nb, Ca, Co, Mo and Ta, from 0.005 to 0.1% by weight of Sc and the balance being aluminum and unavoidable impurities and homogenizing the resultant ingot at a temperature of from 400° to 530° C. for from 8 to 24 hours to make the particle size and volume fraction of spheroidal dispersed particles of intermetallic compounds of the elements mentioned above from 10 to 200 nm and from 0.1 to 4.0%, respectively, and a step of hot working the resultant product at a temperature of less than 300° C. to give a working ratio of at least 50% and to make the mean grain size from 0.1 to 10 μm.

5. A process for producing a superplastic aluminum alloy, comprising a step of melting and casting an aluminum comprising alloy from 7 to 15% by weight of Mg, from 0.1 to 1.0% by weight of one or more elements selected from the group consisting of misch metal (Mm), Zr, V, W, Ti, Ni, Nb, Ca, Co, Mo and Ta, from 0.1 to 2.0% by weight of Cu and/or Li and the balance being aluminum and unavoidable impurities, and homogenizing the ingot at a temperature of from 400° to 530° C. for from 8 to 24 hours, a step of hot working the resultant ingot at a temperature from 400° to 560° C. to give a working ratio from 10 to 40%, a step of precipitation treatment of the product at a temperature from 400° to 530° C., and a step of subjecting the resultant product to a second hot working at a temperature of from 300° to 400° C. to give a working ratio of at least 40% in the second not working alone and subsequently rapidly cooling the product.

6. The process of claim 5, wherein the alloy further contains from 0.01 to 0.2% by weight of one or more elements selected from the group consisting of Sn, In and Cd.

7. A process for producing a superplastic aluminum alloy, comprising a step of melting and casting an aluminum alloy comprising from 4 to less than 7% by weight of Mg, from 0.1 to 1.0% by weight of one or more elements selected from the group consisting of misch metal (Mm), Zr, V, W, Ti, Ni, Nb, Ca, Co, Mo and Ta, from 0.1 to 2.0% by weight of Cu and/or Li and the balance being aluminum and unavoidable impurities, and homogenizing the ingot at a temperature of from 400° to 560° C. for from 8 to 24 hours, a step of hot working the resultant ingot at a temperature of from 400° to 560° C. to give a working ratio from 10 to 40%, a step of precipitation treating the product at a temperature of from 400° to 560° C., and a step of subjecting the resultant product to a second hot working at a temperature of from 200° to 300° C. to give a working ratio of at least 40% in the second hot working alone and subsequently rapidly cooling the product.

8. The process of claim 7, wherein the alloy further contains from 0.01 to 0.2% by weight of one or more elements selected from the group consisting of Sn, In and Cd.

9. A process for producing a superplastic aluminum alloy, comprising a step of melting and casting an aluminum alloy comprising from 4 to less than 7% by weight of Mg, from 0.1 to 1.0% by weight of one or more elements selected from the group consisting of misch metal (Mm), Zr, V, W, Ti, Nb, Ca, Co, Mo and Ta and the balance being Al and unavoidable impurities, and working the resultant ingot at a temperature of less than 400° C. to give a working ratio of at least 10%, a step of precipitation treating the product at a temperature from 400° to 560° C. for from 4 to 20 hours, and a step of subjecting the resultant product to a second hot working at a temperature of less than 300° C. to give a working ratio of at least 40% in the second hot working alone, so that said superplastic aluminum alloy has a controlled structure which contains from 0.1 to 4.0% by volume fraction of spheroidal precipitates composed of intermetallic compounds of the elements mentioned above and having a particle size from 10 to 100 nm, and which has a mean grain size from 0.1 to 10 μm.

* * * * *